US012692803B2

(12) United States Patent
Miki et al.

(10) Patent No.: US 12,692,803 B2
(45) Date of Patent: Jul. 28, 2026

(54) POWER GENERATION FACILITY

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Hiromutsu Miki, Yokohama Kanagawa (JP); Keiko Shimizu, Kawasaki Kanagawa (JP); Hiroki Shiraishi, Yokohama Kanagawa (JP); Yoshihiro Iwata, Kawasaki Kanagawa (JP); Yukitoshi Oota, Yokohama Kanagawa (JP)

(73) Assignees: KABUSHIKI KAISHA TOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 18/890,963

(22) Filed: Sep. 20, 2024

(65) Prior Publication Data

US 2025/0012207 A1 Jan. 9, 2025

Related U.S. Application Data

(62) Division of application No. 18/354,920, filed on Jul. 19, 2023, now abandoned.

(30) Foreign Application Priority Data

Oct. 5, 2022 (JP) ..... 2022-161064

(51) Int. Cl.
*F01K 3/16* (2006.01)
*F01K 3/06* (2006.01)
(Continued)

(52) U.S. Cl.
CPC ..... *F01K 3/16* (2013.01); *F01K 3/06* (2013.01); *F01K 7/40* (2013.01); *F22D 1/325* (2013.01)

(58) Field of Classification Search
CPC ..... F01K 3/00; F01K 3/06; F01K 3/14; F01K 3/16; F01K 3/186; F01K 7/40; F22D 1/325; Y02E 60/14
See application file for complete search history.

(56) References Cited

U.S. PATENT DOCUMENTS 10,323,543 B2 6/2019 Rosenfeld et al.
2002/0059792 A1* 5/2002 Oto ..... F01K 23/106 60/39.182
(Continued)

FOREIGN PATENT DOCUMENTS

CN 113833541 A 12/2021
CN 114592934 A 6/2022
(Continued)

OTHER PUBLICATIONS

EP Search Report for Appl. Ser. No. EP 23186639 dated Mar. 12, 2024.
(Continued)

*Primary Examiner* — Loren C Edwards
(74) *Attorney, Agent, or Firm* — Foley & Lardner LLP

(57) ABSTRACT

A power generation facility in an embodiment includes: a boiler; a high-pressure turbine to which steam generated in the boiler is introduced; a low-pressure turbine provided downstream of the high-pressure turbine; and a condenser that condenses steam discharged from the low-pressure turbine. The power generation facility further includes: a feed pipe that leads feedwater in the condenser to the boiler; a heat storage and steam generation device that has a heat storage function that uses surplus energy generated in an own system to store heat, and a steam generation function
(Continued)

that has part of feedwater led by the feed pipe introduced thereinto and turns the feedwater into steam by the stored heat; and a steam supply pipe that supplies steam generated in the heat storage and steam generation device to an own system.

3 Claims, 14 Drawing Sheets

(51) Int. Cl.
*F01K 7/40* (2006.01)
*F22D 1/32* (2006.01)

(56) References Cited

U.S. PATENT DOCUMENTS

| | | | | |
|---|---|---|---|---|
| 2015/0267566 | A1* | 9/2015 | Vamvas | F28D 20/02 60/659 |
| 2018/0298787 | A1* | 10/2018 | Becker | F01K 3/188 |
| 2024/0035396 | A1 | 2/2024 | Song et al. | |

FOREIGN PATENT DOCUMENTS

| | | | | | |
|---|---|---|---|---|---|
| CN | 114893265 | A | | 8/2022 | |
| DE | 10 2018 213 064 | A1 | | 2/2020 | |
| IN | 202117037675 | A | | 12/2021 | |
| JP | S6297203 | A | | 5/1987 | |
| JP | 2012207542 | A | * | 10/2012 | F01D 15/08 |
| JP | 2020-125857 | A | | 8/2020 | |
| JP | 2021-001597 | A | | 1/2021 | |
| JP | 2021-021524 | A | | 2/2021 | |
| JP | 2022-124996 | A | | 8/2022 | |
| JP | 2023-080811 | A | | 6/2023 | |
| WO | WO-2020158941 | A1 | * | 8/2020 | F01K 27/02 |

OTHER PUBLICATIONS

JP Office Action issued in corresponding Japanese Patent Application No. 2022-161064. dated Sep. 9, 2025 (10 pages).

* cited by examiner

POWER GENERATION FACILITY

CROSS REFERENCE TO RELATED APPLICATIONS

This application is a divisional of U.S. patent application Ser. No. 18/354,920, filed on Jul. 19, 2023, which is based upon and claims the benefit of priority from Japanese Patent Application No. 2022-161064, filed on Oct. 5, 2022; the entire contents of which are incorporated herein by reference.

FIELD

Embodiments described herein relate generally to a power generation facility.

BACKGROUND

In recent years, the introduction of renewable energy has been accelerated as a measure to reduce carbon dioxide ($CO_2$) emissions in power generation facilities. The renewable energies such as solar power and wind power are energies derived from nature. In power generation using such renewable energy, unstable power supply is a problem because the amount of power generated varies depending on weather conditions or other factors.

Therefore, when power supply variations occur in power generation using such renewable energy, the output in thermal power generation facilities is sometimes adjusted in order to maintain stable power supply.

In a steam power generation facility provided with a boiler and a steam turbine, which is a thermal power generation facility, the boiler and the steam turbine have a continuously operable minimum load constraint due to equipment constraints in the boiler and in the steam turbine. Therefore, the loads on the boiler and the steam turbine cannot be reduced below the minimum load even during the daytime when the supply of renewable energy increases.

In general, the minimum load is higher for boilers than for steam turbines. Although the minimum load can be reduced by dumping surplus steam from a boiler into a condenser, the amount of heat corresponding to the surplus steam is wasted. Therefore, in conventional steam power generation facilities, the technique to store the heat of surplus steam from the boiler is being studied. This stored heat is used as a heat source for other systems.

Here, during the evening or the like when the supply of renewable energy decreases, a load increase request is made for the steam power generation facility. However, even when such a load increase request is made, the increase rate of the amount of steam in the boiler, which is the ratio of an increase in steam generation amount to time, is limited, and thus it is impossible to immediately increase the generation amount of steam from the boiler.

Further, in conventional steam power generation facilities, when increasing the steam generation amount, a predetermined amount of time is required until the steam to be introduced into the steam turbine reaches the steam at a predetermined temperature and pressure.

In conventional steam power generation facilities, the load increase rate, which is the ratio of load increase to time in responding to the load increase request, depends on the increase rate of steam in the boiler. Therefore, in the conventional steam power generation facilities, a relatively long time is required until the load reaches a required load, and there is room for improving the load responsiveness to the load increase request.

DETAILED DESCRIPTION

There will be explained embodiments of the present invention below with reference to the drawings.

In one embodiment, a power generation facility includes a boiler that generates steam, a first steam turbine into which steam generated in the boiler is introduced, a second steam turbine provided downstream of the first steam turbine in a flow direction of steam flow, a condenser that condenses steam discharged from the second steam turbine, and a feed pipe that leads condensed water condensed in the condenser to the boiler as feedwater.

The power generation facility further includes a heat storage and steam generation device having a heat storage function that uses surplus energy generated in an own system to store heat, and a steam generation function that has part of feedwater led by the feed pipe introduced thereinto and turns the feedwater into steam by the stored heat, and a steam supply pipe that supplies steam generated in the heat storage and steam generation device to an own system.

Here, in a steam power generation facility including a boiler and a steam turbine, the boiler and the steam turbine have a continuously operable minimum load constraint due to equipment constraints in the boiler and the steam turbine.

Figure 1:
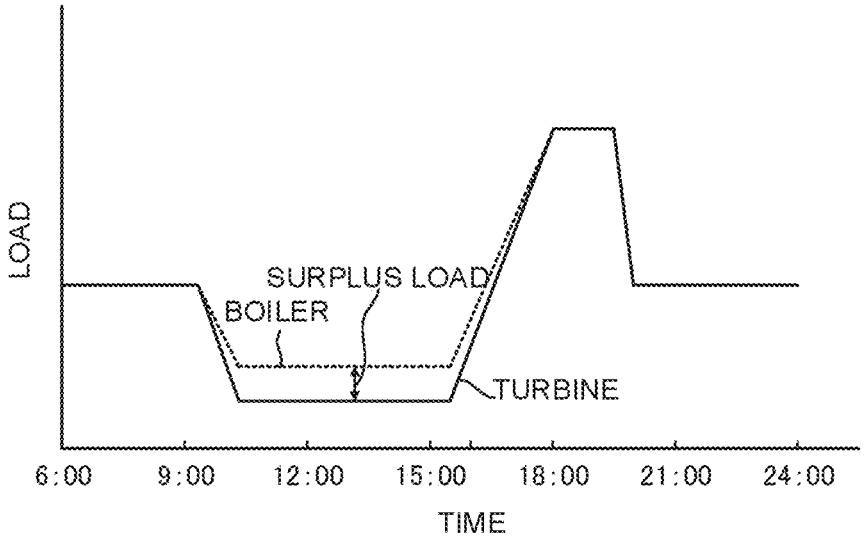
FIG. 1 is a view illustrating an example of variations in boiler load and turbine load at a predetermined time in a general steam power generation facility.

FIG. 1 is a view illustrating an example of variations in boiler load and turbine load at a predetermined time in a general steam power generation facility. In FIG. 1, the solid line indicates the turbine load and the dotted line indicates the boiler load.

As illustrated in FIG. 1, for example, during the daytime when the supply of renewable energy increases, the loads on the boiler and the steam turbine decrease. However, as mentioned above, the boiler and the steam turbine have the continuously operable minimum load constraint. The minimum load is generally higher for boilers than for steam turbines. Therefore, a surplus load corresponding to the difference between the boiler load and the turbine load, that is, surplus energy is generated.

In the embodiments to be explained below, this surplus energy is stored as heat, and when a load increase request is made for the steam power generation facility during the evening when the supply of renewable energy decreases, steam is generated using the stored heat. Then, the generated steam is used in the own system, thereby improving the responsiveness to the load increase.

First Embodiment

Figure 2:
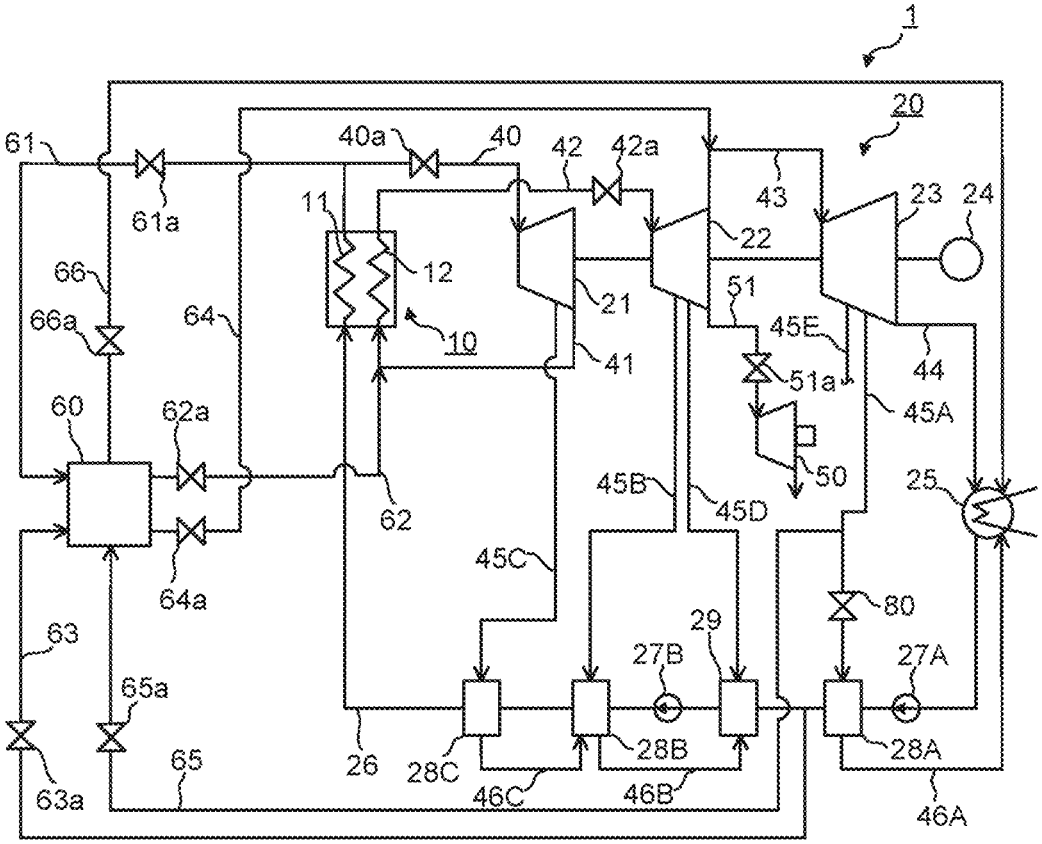
FIG. 2 is a system diagram schematically illustrating a configuration of a power generation facility in a first embodiment.

FIG. 2 is a system diagram schematically illustrating a configuration of a power generation facility 1 in a first embodiment.

As illustrated in FIG. 2, the power generation facility 1 includes a boiler device 10, a steam turbine system 20, and a heat storage and steam generation device 60 as its main components. The power generation facility 1 is a steam power generation facility including the boiler device 10 and the steam turbine system 20.

The boiler device 10 includes, for example, a boiler 11 that generates steam and a reheat boiler 12 that reheats steam. Here, as the boiler device 10, a configuration is explained in which the boiler 11 and the reheat boiler 12 are provided together, but the boiler 11 and the reheat boiler 12 may be configured separately.

The steam turbine system 20 includes a high-pressure turbine 21, an intermediate-pressure turbine 22, a low-pressure turbine 23, a generator 24, a condenser 25, a feed pipe 26, feed pumps 27A and 27B, feedwater heaters 28A, 28B, and 28C, and a deaerator 29. The high-pressure turbine 21 functions as a first steam turbine, the intermediate-pressure turbine 22 functions as a third steam turbine, and the low-pressure turbine 23 functions as a second steam turbine.

The high-pressure turbine 21, the intermediate-pressure turbine 22, and the low-pressure turbine 23 are provided in this order in the flow direction of steam flow. That is, in the flow direction of steam flow, the intermediate-pressure turbine 22 is provided downstream of the high-pressure turbine 21, and the low-pressure turbine 23 is provided downstream of the intermediate-pressure turbine 22.

The generator 24 is connected to the low-pressure turbine 23, for example. Here, an example is explained in which respective rotors in the high-pressure turbine 21, the intermediate-pressure turbine 22, the low-pressure turbine 23, and the generator 24 are uniaxially connected.

The outlet of the boiler 11 is connected to the inlet of the high-pressure turbine 21 via a main steam pipe 40. The main steam pipe 40 includes a pressure and flow rate regulating valve 40*a*. The outlet of the high-pressure turbine 21 is connected to the inlet of the reheat boiler 12 via a low-temperature reheat steam pipe 41. The outlet of the reheat boiler 12 is connected to the inlet of the intermediate-pressure turbine 22 via a high-temperature reheat steam pipe 42. The high-temperature reheat steam pipe 42 includes a pressure and flow rate regulating valve 42*a*.

The outlet of the intermediate-pressure turbine 22 is connected to the inlet of the low-pressure turbine 23 via a crossover pipe 43. Further, a steam supply pipe 51 for connecting to the inlet of a feed pump drive turbine 50 for driving the feed pumps 27A and 27B is connected to the outlet of the intermediate-pressure turbine 22. The steam supply pipe 51 includes a flow rate regulating valve 51*a*. The steam supply pipe 51 functions as a steam supply pipe for a feed pump drive turbine.

The outlet of the low-pressure turbine 23 is connected to the condenser 25 via an exhaust pipe 44. The feedwater outlet of the condenser 25 is connected to the inlet of the boiler 11 via the feed pipe 26.

The feed pipe 26 is provided through the feed pumps 27A and 27B, the feedwater heaters 28A, 28B, and 28C, and the deaerator 29, for example.

The feedwater heater 28A is connected to a predetermined turbine stage of the low-pressure turbine 23 via an extraction steam pipe 45A. The feedwater heater 28B is connected to a predetermined turbine stage of the intermediate-pressure turbine 22 via an extraction steam pipe 45B. The feedwater heater 28C is connected to a predetermined turbine stage of the high-pressure turbine 21 via an extraction steam pipe 45C. The deaerator 29 is connected to a predetermined turbine stage of, for example, the intermediate-pressure turbine 22 via an extraction steam pipe 45D.

Further, the feedwater heater 28A is connected to a discharge pipe 46A that leads extraction steam after being subjected to heat exchange to the condenser 25. Between the feedwater heater 28B and the deaerator 29, there is provided a discharge pipe 46B that leads extraction steam after being subjected to heat exchange in the feedwater heater 28B to the deaerator 29. Between the feedwater heater 28C and the feedwater heater 28B, there is provided a discharge pipe 46C that leads extraction steam after being subjected to heat exchange in the feedwater heater 28C to the feedwater heater 28B.

Although the example including the three feedwater heaters 28A, 28B, and 28C has been explained here, the present invention is not limited to the configuration. For example, at least one feedwater heater may be provided, and four or more feedwater heaters may be provided.

The feed pumps 27A and 27B pump the condensed water condensed in the condenser 25 into the boiler 11 as feedwater. The feed pump 27A on the upstream side functions as, for example, a low-pressure feed pump, and the feed pump 27B on the downstream side functions as, for example, a high-pressure feed pump.

The heat storage and steam generation device 60 has a heat storage function that uses surplus energy generated in an own system to store heat and a steam generation function that has part of feedwater led by the feed pipe 26 introduced thereinto and turns the feedwater into steam by the stored heat. The heat storage function functions when storing heat by using the surplus energy. The steam generation function functions when turning feedwater into steam by the stored heat.

Here, in the power generation facility 1 in the first embodiment illustrated in FIG. 2, the configuration for exhibiting the heat storage function is referred to as a first heat storage structure and the configuration for exhibiting the steam generation function is referred to as a first steam generation structure. Further, the operation in the first heat storage structure is referred to as a first heat storage mode operation, and the operation in the first steam generation structure is referred to as a first steam generation mode operation.

The first heat storage structure includes the heat storage and steam generation device 60, a steam supply pipe for heat storage 61, a steam discharge pipe for heat storage 62, and a drain pipe 66. The first steam generation structure includes the heat storage and steam generation device 60, a feedwater supply pipe for steam generation 63, a steam supply pipe 64, and a water supply pipe for heat storage material 65.

The heat storage and steam generation device 60 includes a chemical heat storage material. The case of using a $CaO/H_2O$-based or $MgO/H_2O$-based chemical heat storage material that uses dehydration and hydration reactions is explained as an example, here. The configuration of the heat storage and steam generation device 60 will be explained later.

As illustrated in FIG. 2, the steam supply pipe for heat storage 61, the steam discharge pipe for heat storage 62, the feedwater supply pipe for steam generation 63, the steam supply pipe 64, the water supply pipe for heat storage material 65, and the drain pipe 66 are connected to the heat storage and steam generation device 60.

The steam supply pipe for heat storage 61 supplies steam for heat storage (surplus steam) to the heat storage and steam generation device 60 during the first heat storage mode operation. One end of the steam supply pipe for heat storage 61 is connected to the main steam pipe 40 between the boiler 11 and the pressure and flow rate regulating valve 40*a*, and the other end of the steam supply pipe for heat storage 61 is connected to the heat storage and steam generation device 60. The steam supply pipe for heat storage 61 includes a flow rate regulating valve 61*a*.

The steam discharge pipe for heat storage 62 discharges the steam that has provided heat to the heat storage material in the heat storage and steam generation device 60. One end of the steam discharge pipe for heat storage 62 is connected to the low-temperature reheat steam pipe 41. The other end of the steam discharge pipe for heat storage 62 is connected to the heat storage and steam generation device 60. The steam discharge pipe for heat storage 62 includes a flow rate regulating valve 62*a*.

The feedwater supply pipe for steam generation 63 supplies part of feedwater to the heat storage and steam generation device 60 during the first steam generation mode operation. One end of the feedwater supply pipe for steam generation 63 is connected to the feed pipe 26. The other end of the feedwater supply pipe for steam generation 63 is connected to the heat storage and steam generation device 60. The feedwater supply pipe for steam generation 63 includes a flow rate regulating valve 63*a*.

Although the example where one end of the feedwater supply pipe for steam generation 63 is connected to the feed pipe 26 between the feedwater heater 28A and the deaerator 29 has been explained here, the present invention is not limited to this configuration. The position of the feedwater supply pipe for steam generation 63 connected to the feed pipe 26 is appropriately set based on, for example, the set temperature or the set pressure of feedwater to be supplied to the heat storage and steam generation device 60.

For example, the feedwater supply pipe for steam generation 63 may be connected to the feed pipe 26 between the deaerator 29 and the feed pump 27B. Further, the feedwater supply pipe for steam generation 63 may be connected to the feed pipe 26 between the feedwater heater 28A and the feed pump 27A. In order to supply feedwater to the heat storage and steam generation device 60 through the feedwater supply pipe for steam generation 63, the feedwater supply pipe for steam generation 63 is connected to the feed pipe 26 downstream of the feed pump 27A.

The steam supply pipe 64 supplies the steam generated in the heat storage and steam generation device 60 to the own system during the steam generation mode operation. One end of the steam supply pipe 64 is connected to the crossover pipe 43, for example. The other end of the steam supply pipe 64 is connected to the heat storage and steam generation device 60. The steam supply pipe 64 includes a flow rate regulating valve 64*a*.

The water supply pipe for heat storage material 65 supplies water or water vapor to be used for a hydration reaction in the chemical heat storage material during the first steam generation mode operation. One end of the water supply pipe for heat storage material 65 is connected to the extraction steam pipe 45A, for example. The other end of the water supply pipe for heat storage material 65 is connected to the heat storage and steam generation device 60. The water supply pipe for heat storage material 65 includes a flow rate regulating valve 65*a*.

For example, a flow rate regulating valve 80 is provided in the extraction steam pipe 45A on the side of the feedwater heater 28A relative to the position where one end of the water supply pipe for heat storage material 65 is connected.

The example where one end of the water supply pipe for heat storage material 65 is connected to the extraction steam pipe 45A is explained here. One end of the water supply pipe for heat storage material 65 may be connected to the extraction steam pipe 45B, 45C, or 45D, for example. One end of the water supply pipe for heat storage material 65 only needs to be connected to a pipe through which water or water vapor that satisfies the conditions necessary for the hydration reaction in the heat storage and steam generation device 60 is obtained.

The drain pipe 66 discharges water or water vapor generated by a dehydration reaction in the chemical heat storage material during the first heat storage mode operation. One end of the drain pipe 66 is connected to the condenser 25. The other end of the drain pipe 66 is connected to the heat storage and steam generation device 60. The drain pipe 66 includes a flow rate regulating valve 66*a*.

Figure 3:
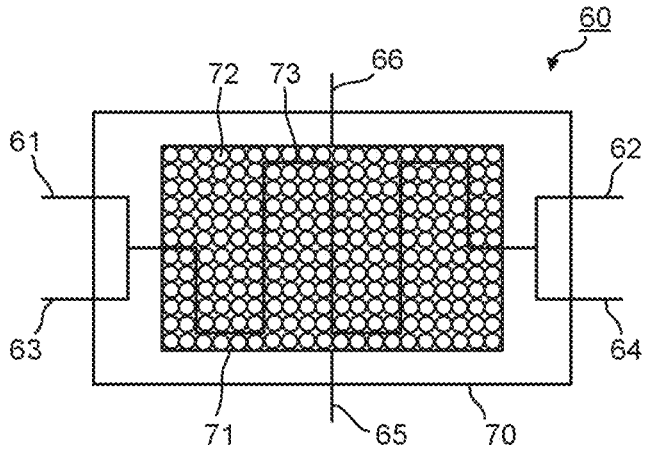
FIG. 3 is a diagram schematically illustrating an internal configuration of a heat storage and steam generation device in the power generation facility in the first embodiment.

Here, FIG. 3 is a diagram schematically illustrating an internal configuration of the heat storage and steam generation device 60 in the power generation facility 1 in the first embodiment.

As illustrated in FIG. 3, the heat storage and steam generation device 60 includes a device container 70, an inner container 71, a chemical heat storage material 72, and a heat exchange pipe 73.

The device container 70 is made of a casing and houses the inner container 71. The inner container 71 is made of a casing, and the inside of the inner container 71 is filled with the chemical heat storage material 72. Further, inside the inner container 71, the heat exchange pipe 73 is arranged in a meandering manner. That is, the heat exchange pipe 73 is arranged to meander between the chemical heat storage materials 72 while being in contact with the chemical heat storage materials 72.

One end of the heat exchange pipe 73 is branched into two branches. One branch is connected to the steam supply pipe for heat storage 61, and the other branch is connected to the feedwater supply pipe for steam generation 63. The other end of the heat exchange pipe 73 is branched into two branches. One branch is connected to the steam discharge pipe for heat storage 62 and the other branch is connected to the steam supply pipe 64.

The water supply pipe for heat storage material 65 is connected to one side of the inner container 71. The drain pipe 66 is connected to the other side of the inner container 71 opposite to one side.

Here, the chemical heat storage material 72 is a heat storage material that can perform heat storage and heat release by using chemical reaction heat generated when a reaction medium and the heat storage material come into contact with each other. The chemical heat storage material 72 uses reversible endothermic and exothermic reactions to perform heat storage and heat release. Examples of the chemical heat storage material 72 include a $CaO/H_2O$-based chemical heat storage material, a $MgO/H_2O$-based chemical heat storage material, and so on. The chemical heat storage material 72 is not limited to these, and may be any chemical heat storage material that can perform heat storage and heat release by using the reversible endothermic and exothermic reactions.

When the chemical heat storage material is used, the stored heat can be released when needed, provided that no chemical change occurs. That is, the chemical heat storage material can maintain a heat storage state for a long period of time.

Next, there is explained the action of the power generation facility 1.

(Main Action in the Steam Turbine System 20)

First, the main action in the steam turbine system 20 in the power generation facility 1 is explained with reference to FIG. 2.

The steam introduced into the high-pressure turbine 21 from the main steam pipe 40 turns the high-pressure turbine 21 and is then introduced into the reheat boiler 12 through the low-temperature reheat steam pipe 41. The steam superheated in the reheat boiler 12 is introduced into the intermediate-pressure turbine 22 through the high-temperature reheat steam pipe 42.

The steam introduced into the intermediate-pressure turbine 22 turns the intermediate-pressure turbine 22 and is then introduced into the low-pressure turbine 23 through the crossover pipe 43. Further, part of the steam discharged from the intermediate-pressure turbine 22 is introduced into the feed pump drive turbine 50 through the steam supply pipe 51. The steam introduced into the feed pump drive turbine 50 turns the feed pump drive turbine 50. The feed pumps 27A and 27B are driven by the turns of the feed pump drive turbine 50. The steam that has turned the feed pump drive turbine 50 is introduced into the condenser 25, for example.

The steam introduced into the low-pressure turbine 23 turns the low-pressure turbine 23 and is then introduced into the condenser 25 through the exhaust pipe 44. The generator 24 is driven by the turns of the low-pressure turbine 23 to generate electric power.

The steam introduced into the condenser 25 is condensed into condensed water. The condensed water in the feed pipe 26 is pumped by the feed pumps 27A and 27B as feedwater to be led to the boiler 11 through the feed pipe 26. As the feedwater flows through the feed pipe 26, it is heated by extraction steam in the feedwater heaters 28A, 28B, and 28C. Further, the feedwater is deaerated in the deaerator 29.

(Action of the Heat Storage and Steam Generation Device 60: During the First Heat Storage Mode Operation)

Next, the action of the heat storage and steam generation device 60 during the first heat storage mode operation is explained with reference to FIG. 2 and FIG. 3.

As mentioned above, when the minimum load operation is performed in the boiler and the steam turbine during the daytime when the supply of renewable energy increases, surplus energy corresponding to the difference between the boiler load and the turbine load is generated. In the heat storage mode operation, this surplus energy is stored in the heat storage and steam generation device 60. This surplus energy is surplus energy generated in the own system.

During the first heat storage mode operation, the flow rate regulating valve 61*a* of the steam supply pipe for heat storage 61 and the flow rate regulating valve 62*a* of the steam discharge pipe for heat storage 62 are opened. The flow rate regulating valve 61*a* is adjusted so that the surplus steam generated in the boiler 11, which has surplus energy, is supplied to the steam supply pipe for heat storage 61.

The flow rate regulating valve 63*a* of the feedwater supply pipe for steam generation 63 and the flow rate regulating valve 64*a* of the steam supply pipe 64 are closed. The flow rate regulating valve 65*a* of the water supply pipe for heat storage material 65 is closed and the flow rate regulating valve 66*a* of the drain pipe 66 is opened.

The open/closed states of the flow rate regulating valves 61*a*, 62*a*, 63*a*, 64*a*, 65*a*, and 66*a* during the heat storage mode operation in each of the embodiments described below are the same as those of the flow rate regulating valves 61*a*, 62*a*, 63*a*, 64*a*, 65*a*, and 66*a* during the first heat storage mode operation described above.

The surplus steam generated in the boiler 11 is introduced into the heat exchange pipe 73 from the main steam pipe 40 through the steam supply pipe for heat storage 61.

Here, for example, when heat is stored in the $CaO/H_2O$-based chemical heat storage material 72, the surplus steam introduced into the heat exchange pipe 73 gives heat to the chemical heat storage material 72 in the state of $Ca(OH)_2$. In other words, the surplus steam introduced into the heat exchange pipe 73 heats the chemical heat storage material 72 in the state of $Ca(OH)_2$. By the dehydration reaction caused thereby, in which $Ca(OH)_2$ is separated into CaO and $H_2O$, heat is stored.

At this time, the surplus steam flowing through the heat exchange pipe 73 heats the chemical heat storage material 72 to a temperature of 400 to 500° C., and thereby, the dehydration reaction is accelerated. The water produced by the dehydration reaction is discharged to the condenser 25 through the drain pipe 66.

For example, when heat is stored in the $MgO/H_2O$-based chemical heat storage material 72, the surplus steam introduced into the heat exchange pipe 73 gives heat to the chemical heat storage material 72 in the state of $Mg(OH)_2$. In other words, the surplus steam introduced into the heat exchange pipe 73 heats the chemical heat storage material 72 in the state of $Mg(OH)_2$. By the dehydration reaction caused thereby, in which $Mg(OH)_2$ is separated into MgO and $H_2O$, heat is stored.

At this time, the surplus steam flowing through the heat exchange pipe 73 heats the chemical heat storage material 72 to a temperature of 200 to 400° C., and thereby, the dehydration reaction is accelerated. The water produced by the dehydration reaction is discharged to the condenser 25 through the drain pipe 66.

The surplus steam that has provided heat to the chemical heat storage material 72 is introduced into the low-temperature reheat steam pipe 41 through the steam discharge pipe for heat storage 62.

(Action of the Heat Storage and Steam Generation Device 60: During the First Steam Generation Mode Operation)

Next, the action of the heat storage and steam generation device 60 during the first steam generation mode operation is explained with reference to FIG. 2 and FIG. 3. Here, in the steam generation mode operation, the action in the chemical heat storage material 72 is to release the stored heat.

As mentioned above, during the evening when the supply of renewable energy decreases, the load increase request is made for the steam power generation facility. In the steam generation mode operation, when the load increase request is made, steam is generated using the stored heat, and the generated steam is used in the own system.

During the first steam generation mode operation, the flow rate regulating valve 61*a* of the steam supply pipe for heat storage 61 and the flow rate regulating valve 62*a* of the steam discharge pipe for heat storage 62 are closed. The flow rate regulating valve 63*a* of the feedwater supply pipe for steam generation 63 and the flow rate regulating valve 64*a* of the steam supply pipe 64 are opened. The flow rate regulating valve 65*a* of the water supply pipe for heat storage material 65 is opened and the flow rate regulating valve 66*a* of the drain pipe 66 is closed.

The open/closed states of the flow rate regulating valves 61*a*, 62*a*, 63*a*, 64*a*, 65*a*, and 66*a* during the steam generation mode operation in each of the embodiments described below are the same as those of the flow rate regulating valves 61*a*, 62*a*, 63*a*, 64*a*, 65*a*, and 66*a* during the first steam generation mode operation described above.

For example, when heat is released in the $CaO/H_2O$-based chemical heat storage material 72, the extraction steam from the extraction steam pipe 45A is supplied to the chemical heat storage material 72 in the state of CaO through the water supply pipe for heat storage material 65. By the hydration reaction caused thereby, in which water vapor and CaO combine, heat is released.

For example, in the case where heat is released in the $MgO/H_2O$-based chemical heat storage material 72, the extraction steam from the extraction steam pipe 45A is supplied to the chemical heat storage material 72 in the state of MgO through the water supply pipe for heat storage material 65. By the hydration reaction caused thereby, in which water vapor and MgO combine, heat is released.

Here, the amount of heat released in the chemical heat storage material 72 by the hydration reaction is adjusted, for example, by the amount of steam supplied through the water supply pipe for heat storage material 65. Here, the example where steam is supplied to the chemical heat storage material 72 through the water supply pipe for heat storage material 65 has been explained, but the same effects as in the case of supplying steam can be obtained also in the case of supplying water.

The feedwater supplied from the feedwater supply pipe for steam generation 63 to the heat exchange pipe 73 is heated by the released heat of the chemical heat storage material 72 to become superheated steam. The steam generated in the heat storage and steam generation device 60 is supplied to, for example, the crossover pipe 43 through the steam supply pipe 64. The steam supplied to the crossover pipe 43 is introduced into the low-pressure turbine 23 together with the steam discharged from the intermediate-pressure turbine 22. Therefore, the amount of steam to be introduced into the low-pressure turbine 23 increases and the turbine output increases.

Figure 4:
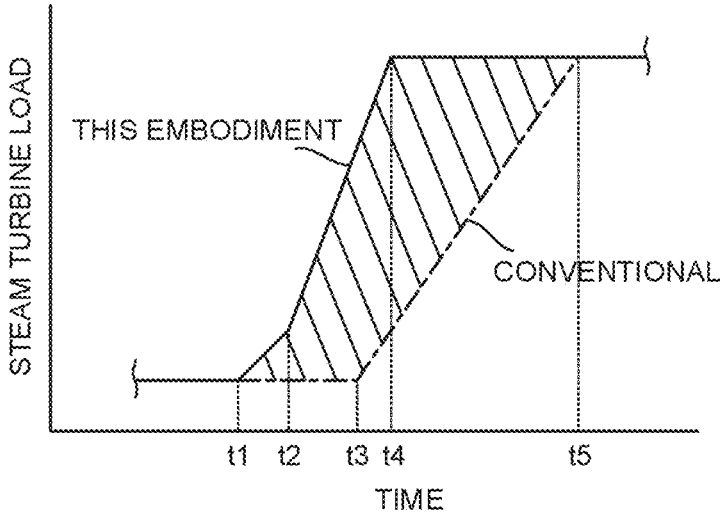
FIG. 4 is a view illustrating a steam turbine load to time when a load is increased based on a load increase request from a minimum load operation state in the power generation facility in the first embodiment.

Here, FIG. 4 is a view illustrating a steam turbine load to time when a load is increased based on a load increase request from the minimum load operation state in the power generation facility 1 in the first embodiment. In FIG. 4, for comparison, the steam turbine load in a conventional steam power generation facility not including the heat storage and steam generation device 60 is indicated by a dot and dash line. Further, a time t1 is when the load increase request is made.

As illustrated in FIG. 4, the steam turbine load increases after the time t1 when the load increase request is made in the power generation facility 1. Then, in the power generation facility 1, the steam turbine load reaches a predetermined steam turbine load at a time t4. Here, at the time t1, the operation is switched from the heat storage mode operation to the steam generation mode operation, and thus, the steam to be introduced into the heat storage and steam generation device 60 through the steam supply pipe for heat storage 61 for heat storage is cut off. Then, the steam, which has been introduced into the heat storage and steam generation device 60, is to be introduced into the high-pressure turbine 21, and thus the steam turbine load increases from the time t1.

Here, from the time t1 to a time t2, the heat storage and steam generation device 60 is idling to allow the chemical heat storage material 72 to start the hydration reaction. Then, when the time reaches the time t2, steam is supplied from the heat storage and steam generation device 60. Therefore, after the time t2, the increase rate of the steam turbine load with respect to time increases.

On the other hand, in the conventional steam power generation facility, the steam turbine load does not increase from the time t1 when the load increase request is made to a time t3. This is because a predetermined amount of time is required until the steam to be introduced into the steam turbine reaches the steam at a predetermined temperature and pressure when increasing the steam generation amount.

In the conventional steam power generation facility, the steam turbine load increases after the time t3 and reaches a predetermined steam turbine load at a time t5. The power generation facility 1 supplies the amount of heat corresponding to the hatched area in FIG. 4 as steam to the low-pressure turbine 23 until the conventional steam power generation facility reaches a predetermined steam turbine load. As a result, the power generation facility 1 has excellent responsiveness to the load increase and can reach the required load in a short period of time.

As described above, according to the power generation facility 1 in the first embodiment, including the heat storage and steam generation device 60 allows the surplus energy generated in the own system to be stored. Further, when the load increase request is made, the heat storage and steam generation device 60 can generate steam using the stored heat. The steam generated in the heat storage and steam generation device 60 is introduced into, for example, the low-pressure turbine 23, which is the own system. This allows the power generation facility 1 to reach the required load in a short period of time and obtain excellent responsiveness to the load increase.

Here, in addition to the above-described power generation facility 1 with the configuration in which, for example, the extraction steam from the intermediate-pressure turbine 22 and the low-pressure turbine 23 is introduced into the feedwater heaters 28A and 28B, there is also a power generation facility with a configuration in which the extraction steam from the intermediate-pressure turbine 22 and the low-pressure turbine 23 is supplied to, for example, an external facility. FIG. 2 illustrates, as an example, an extraction steam pipe 45E that supplies the extraction steam from the low-pressure turbine 23, for example, to an external facility.

Examples of the external facility include a vaporizer that vaporizes a liquid fuel to be burned in the boiler device 10, and so on. Further, examples of the external facility include a carbon dioxide capture and storage system (CCS system) that captures and stores carbon dioxide discharged from the boiler device 10, and so on. The external facility is not particularly limited, and may be any facility that uses the extraction steam from the high-pressure turbine 21, the intermediate-pressure turbine 22, or the low-pressure turbine 23.

In this case as well, during the first steam generation mode operation, the steam generated in the heat storage and steam generation device 60 is introduced into the low-pressure turbine 23 through the steam supply pipe 64, and thus the effect of excellent load responsiveness can be obtained as described above.

In this case, for example, there may be employed a configuration in which the supply of extraction steam from the intermediate-pressure turbine 22 or the low-pressure turbine 23 to the external facility is cut off and the steam generated in the heat storage and steam generation device 60 is supplied to the external facility. In this case, a working fluid flowing through the intermediate-pressure turbine 22 or the low-pressure turbine 23 is not extracted, and thus, the flow rate of the working fluid flowing through the intermediate-pressure turbine 22 or the low-pressure turbine 23 increases. As a result, the effect of excellent load responsiveness can be obtained as described above.

Other Forms in the First Embodiment

Figure 5:
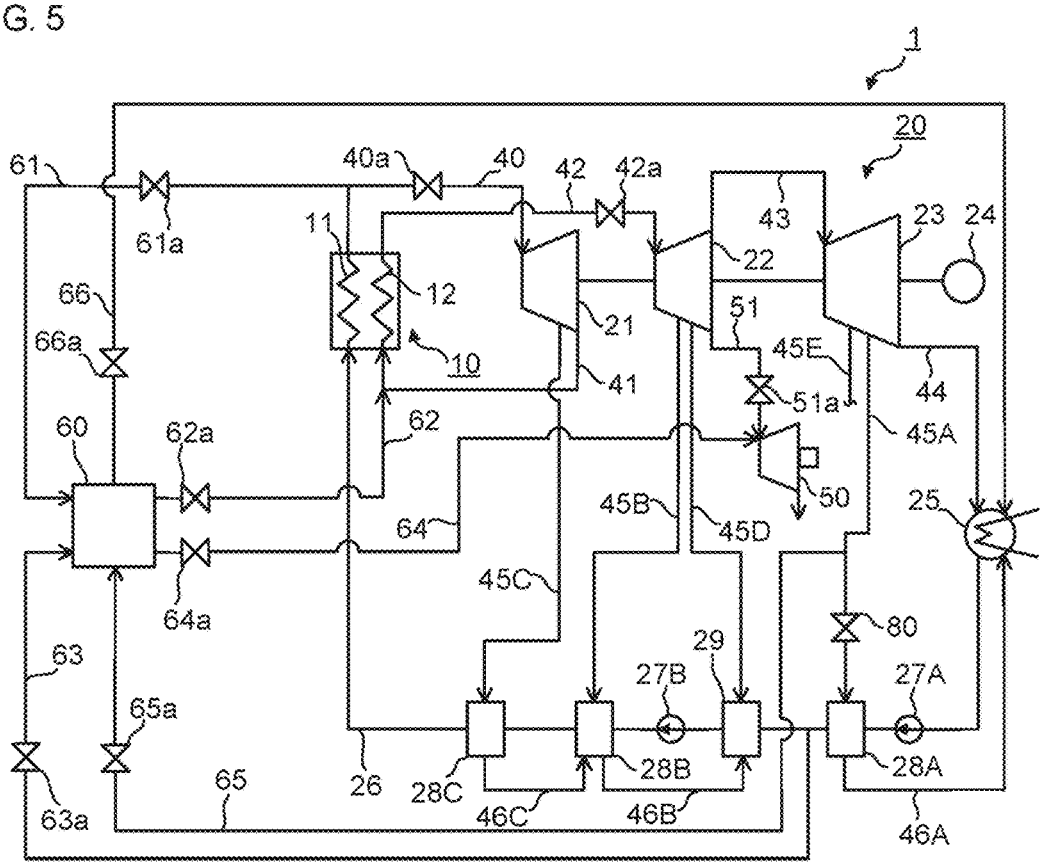
FIG. 5 is a system diagram schematically illustrating another form in the power generation facility in the first embodiment.
Figure 6:
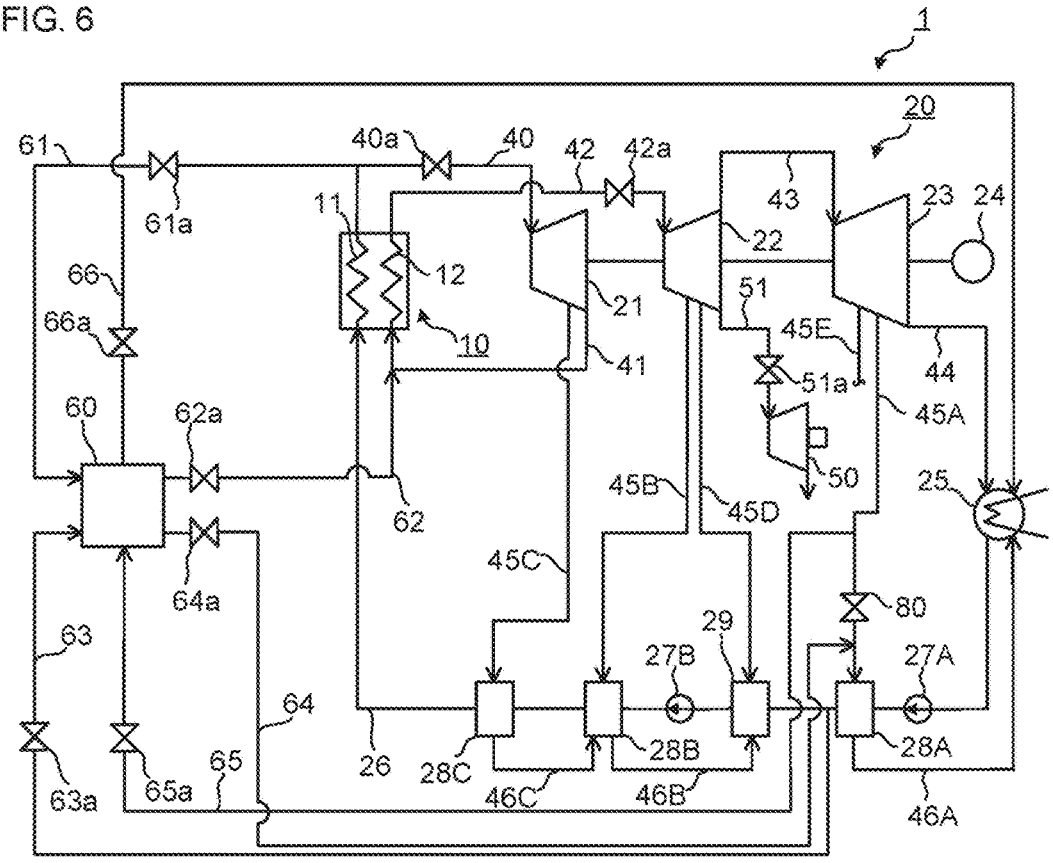
FIG. 6 is a system diagram schematically illustrating another form in the power generation facility in the first embodiment.

FIG. 5 and FIG. 6 each are a system diagram schematically illustrating another form in the power generation facility 1 in the first embodiment. In the forms illustrated in FIG. 5 and FIG. 6, the own system to which the steam generated in the heat storage and steam generation device 60 is supplied is different in the steam generation mode operation.

Here, the configuration for exhibiting the steam generation function in the form illustrated in FIG. 5 is referred to as a second steam generation structure. The operation in the second steam generation structure is referred to as a second steam generation mode operation. Further, the configuration for exhibiting the steam generation function in the form illustrated in FIG. 6 is referred to as a third steam generation structure. The operation in the third steam generation structure is referred to as a third steam generation mode operation.

The second steam generation structure and the third steam generation structure each include the heat storage and steam generation device 60, the feedwater supply pipe for steam generation 63, the steam supply pipe 64, and the water supply pipe for heat storage material 65.

As illustrated in FIG. 5, in the second steam generation structure, one end of the steam supply pipe 64 is connected to the steam inlet of the feed pump drive turbine 50.

During the second steam generation mode operation, the steam generated in the heat storage and steam generation device 60 is supplied to the feed pump drive turbine 50 through the steam supply pipe 64. At this time, the flow rate regulating valve 51*a* of the steam supply pipe 51 is closed. Therefore, the steam discharged from the intermediate-pressure turbine 22 is introduced into the low-pressure turbine 23 through the crossover pipe 43.

Therefore, the steam, which has been supplied to the feed pump drive turbine 50, is to be introduced into the low-pressure turbine 23, and thus the turbine output increases. This also allows the form illustrated in FIG. 5 to reach the required load in a short period of time and obtain excellent responsiveness to the load increase, similarly to the power generation facility 1 in the first embodiment illustrated in FIG. 2.

As illustrated in FIG. 6, in the third steam generation structure, one end of the steam supply pipe 64 is connected to the extraction steam pipe 45A. One end of the steam supply pipe 64 is connected to the side of the feedwater heater 28A relative to the position where the flow rate regulating valve 80 is provided.

During the third steam generation mode operation, the steam generated in the heat storage and steam generation device 60 is supplied to the extraction steam pipe 45A through the steam supply pipe 64. At this time, the flow rate regulating valve 80 is closed. The amount of extraction steam from the low-pressure turbine 23 results in the amount of the steam to be supplied to the heat storage and steam generation device 60 through the water supply pipe for heat storage material 65. Therefore, the amount of extraction steam from the low-pressure turbine 23 decreases and thus the turbine output increases. This also allows the form illustrated in FIG. 6 to reach the required load in a short period of time and obtain excellent responsiveness to the load increase, similarly to the power generation facility 1 in the first embodiment illustrated in FIG. 2.

Second Embodiment

Figure 7:
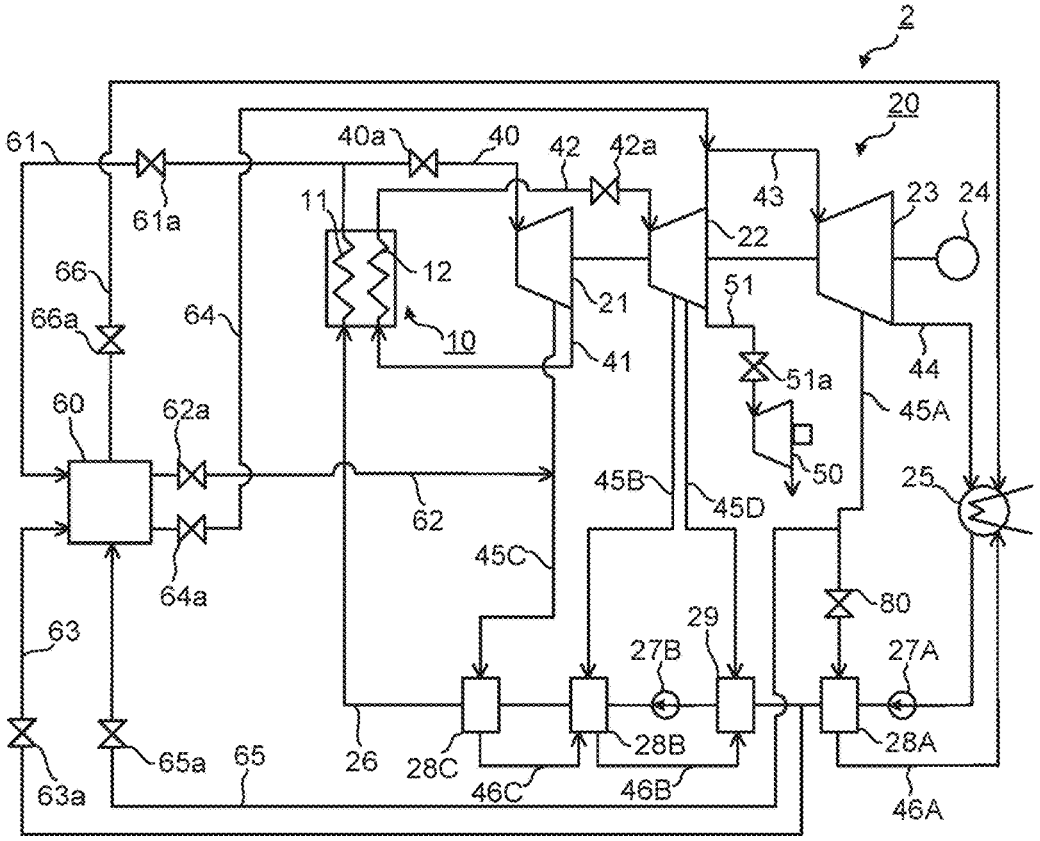
FIG. 7 is a system diagram schematically illustrating a configuration of a power generation facility in a second embodiment.

FIG. 7 is a system diagram schematically illustrating a configuration of a power generation facility 2 in a second embodiment. In the following embodiment, the components that are the same as those of the power generation facility 1 in the first embodiment are denoted by the same reference numerals and symbols, and redundant explanations are omitted or simplified.

The configuration of the power generation facility 2 in the second embodiment is the same as that of the power generation facility 1 in the first embodiment illustrated in FIG. 2 except for the connection configuration of the steam discharge pipe for heat storage 62. Therefore, the configuration different from the configuration of the power generation facility 1 in the first embodiment is mainly explained here. The configuration of the steam generation function in the power generation facility 2 in the second embodiment illustrated in FIG. 7 is the aforementioned first steam generation structure.

Here, the configuration for exhibiting the heat storage function in the power generation facility 2 in the second embodiment illustrated in FIG. 7 is referred to as a second heat storage structure. The operation in the second heat storage structure is referred to as a second heat storage mode operation.

The second heat storage structure includes the heat storage and steam generation device 60, the steam supply pipe for heat storage 61, the steam discharge pipe for heat storage 62, and the drain pipe 66.

As illustrated in FIG. 7, in the second heat storage structure, one end of the steam discharge pipe for heat storage 62 is connected to the extraction steam pipe 45C. The example where one end of the steam discharge pipe for heat storage 62 is connected to the extraction steam pipe 45C has been explained here, but one end of the steam discharge pipe for heat storage 62 may be connected to the other extraction steam pipe 45B, 45D, or 45A, for example. The extraction steam pipe 45B, 45C, 45D, or 45A to which one end of the steam discharge pipe for heat storage 62 is connected may be set based on the temperature of the steam supplied from the steam discharge pipe for heat storage 62, for example.

During the second heat storage mode operation, the surplus steam is supplied from the main steam pipe 40 to the heat storage and steam generation device 60 through the steam supply pipe for heat storage 61. Then, the surplus steam that has provided heat to the chemical heat storage material 72 by the aforementioned action is introduced into the extraction steam pipe 45C through the steam discharge pipe for heat storage 62. Thereby, the temperature of the feedwater rises, and the cycle thermal efficiency during the second heat storage mode operation is improved. The energy of the surplus steam to be supplied to the heat storage and steam generation device 60 through the steam supply pipe for heat storage 61 functions as surplus energy generated in the own system.

Further, including the first steam generation structure, the power generation facility 2 can obtain the same effects as those obtained by including the aforementioned first steam generation structure.

According to the power generation facility 2 in the second embodiment, including the heat storage and steam generation device 60 makes it possible to obtain the same effects as those in the power generation facility 1 in the first embodiment. That is, the power generation facility 2 in the second embodiment can reach the required load in a short period of time and obtain excellent responsiveness to the load increase.

Figure 8:
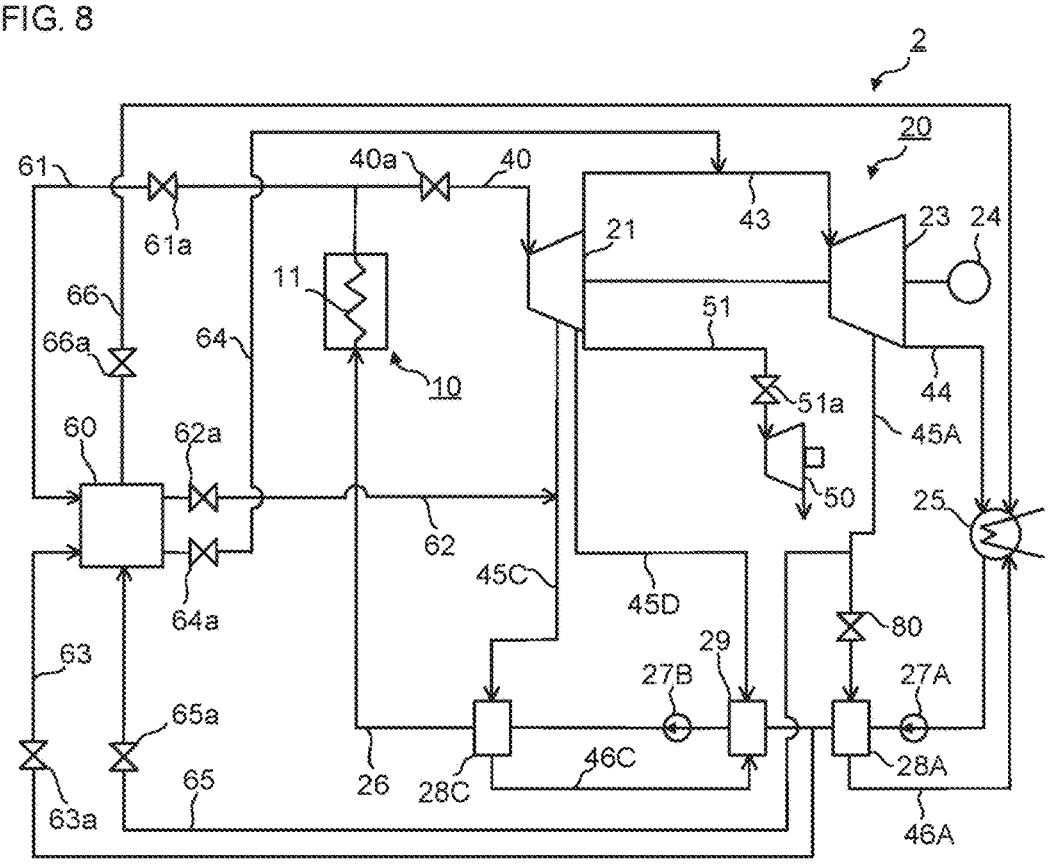
FIG. 8 is a system diagram schematically illustrating a configuration of the power generation facility in the second embodiment without including an intermediate-pressure turbine.

Here, the power generation facility 2 in the second embodiment may have a configuration not including the intermediate-pressure turbine 22. FIG. 8 is a system diagram schematically illustrating a configuration of the power generation facility 2 in the second embodiment without including the intermediate-pressure turbine 22.

The power generation facility 2 illustrated in FIG. 8 does not include the intermediate-pressure turbine 22, and therefore, also does not include the reheat boiler 12, the low-temperature reheat steam pipe 41, or the high-temperature reheat steam pipe 42. The outlet of the high-pressure turbine 21 is connected to the inlet of the low-pressure turbine 23 via the crossover pipe 43.

The configuration of the high-pressure turbine 21 and the low-pressure turbine 23 may be provided in an integrated casing. In this case, the steam discharged from the high-pressure turbine 21 is introduced into the low-pressure turbine 23 without flowing through the crossover pipe 43. Further, the steam to be supplied through the steam supply pipe 64 is supplied to a first-stage stationary blade of the low-pressure turbine 23 or an upstream turbine stage.

Part of the steam discharged from the high-pressure turbine 21 is introduced into the feed pump drive turbine 50 through the steam supply pipe 51. Further, the extraction steam from a predetermined turbine stage of the high-pressure turbine 21 is introduced into the deaerator 29 through the extraction steam pipe 45D.

During the first steam generation mode operation, the superheated steam generated in the heat storage and steam generation device 60 is supplied to the crossover pipe 43 through the steam supply pipe 64.

The power generation facility 2 illustrated in FIG. 8 can also obtain the same effects as those in the power generation facility 2 illustrated in FIG. 7.

Other Forms in the Second Embodiment

Figure 9:
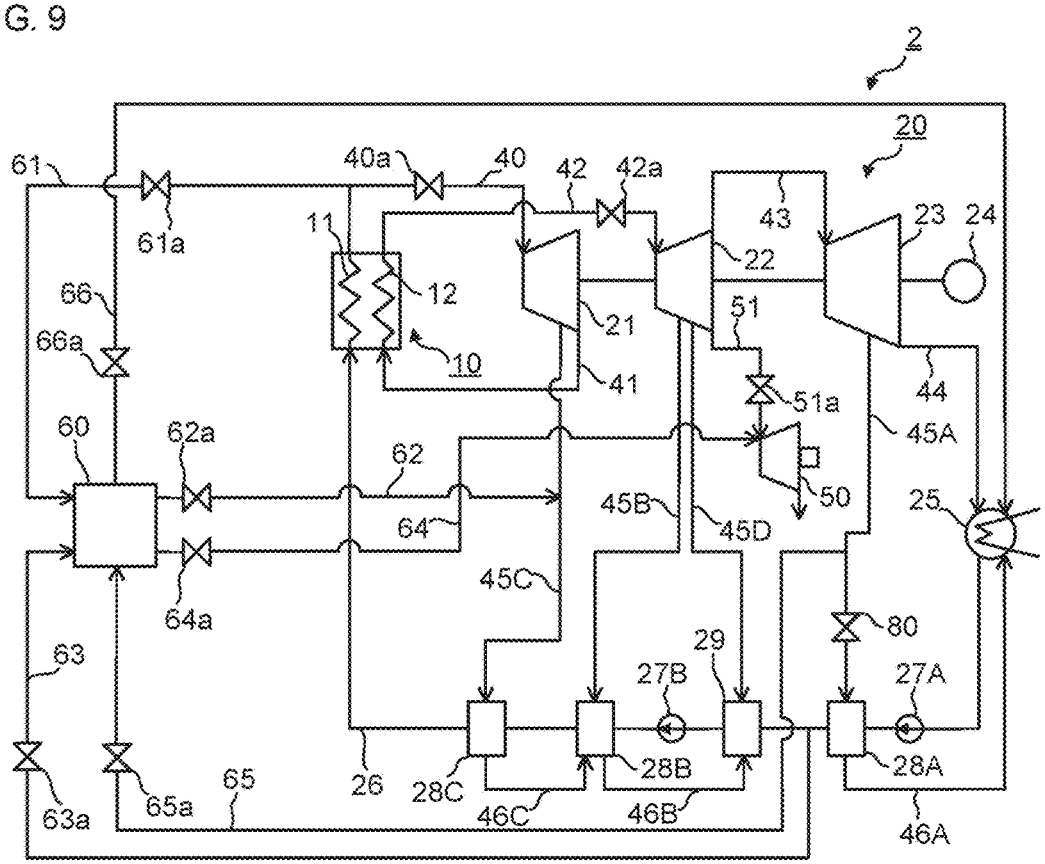
FIG. 9 is a system diagram schematically illustrating another form in the power generation facility in the second embodiment.
Figure 10:
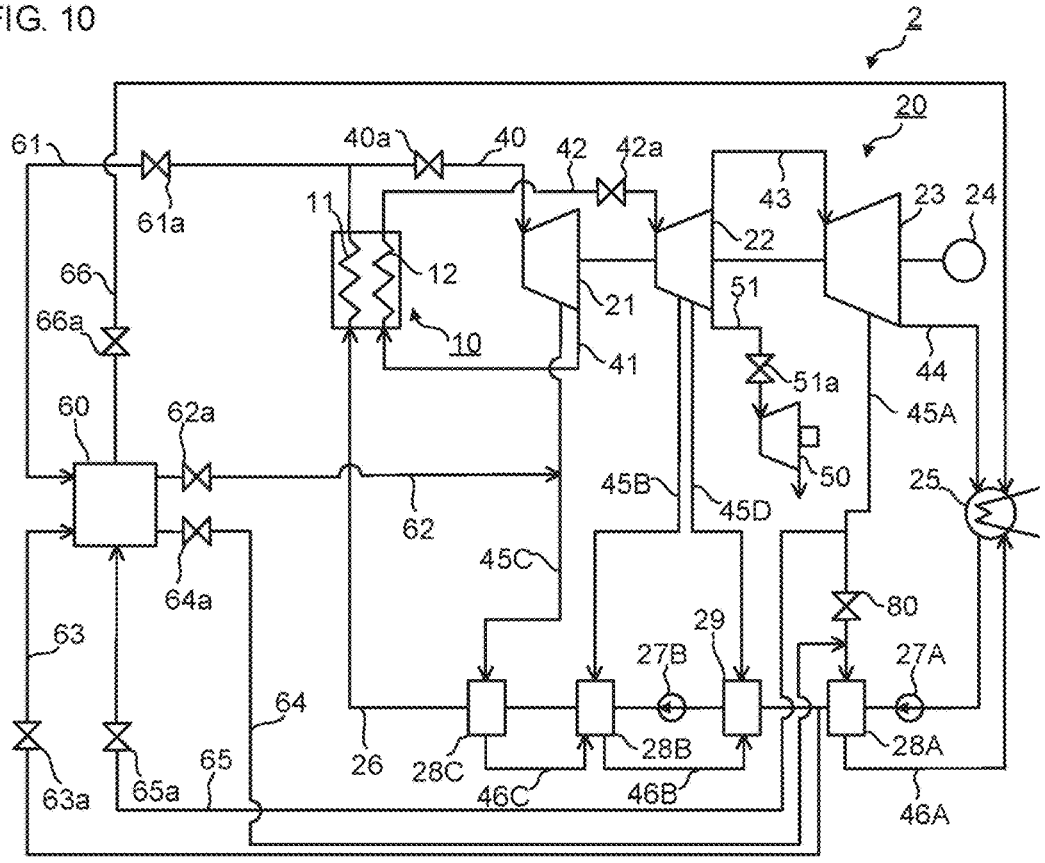
FIG. 10 is a system diagram schematically illustrating another form in the power generation facility in the second embodiment.

FIG. 9 and FIG. 10 each are a system diagram schematically illustrating another form in the power generation facility 2 in the second embodiment. In the forms illustrated in FIG. 9 and FIG. 10, the own system to which the steam generated in the heat storage and steam generation device 60 is supplied is different in the steam generation mode operation.

The configuration of the steam generation function in the form illustrated in FIG. 9 is the aforementioned second steam generation structure and performs the second steam generation mode operation. Therefore, it is possible to obtain the same effects as those obtained by including the aforementioned second steam generation structure. That is, the form illustrated in FIG. 9 can reach the required load in a short period of time and obtain excellent responsiveness to the load increase.

The configuration of the steam generation function in the form illustrated in FIG. 10 is the aforementioned third steam generation structure and performs the third steam generation mode operation. Therefore, it is possible to obtain the same effects as those obtained by including the aforementioned third steam generation structure. That is, the form illustrated in FIG. 10 can reach the required load in a short period of time and obtain excellent responsiveness to the load increase.

Third Embodiment

Figure 11:
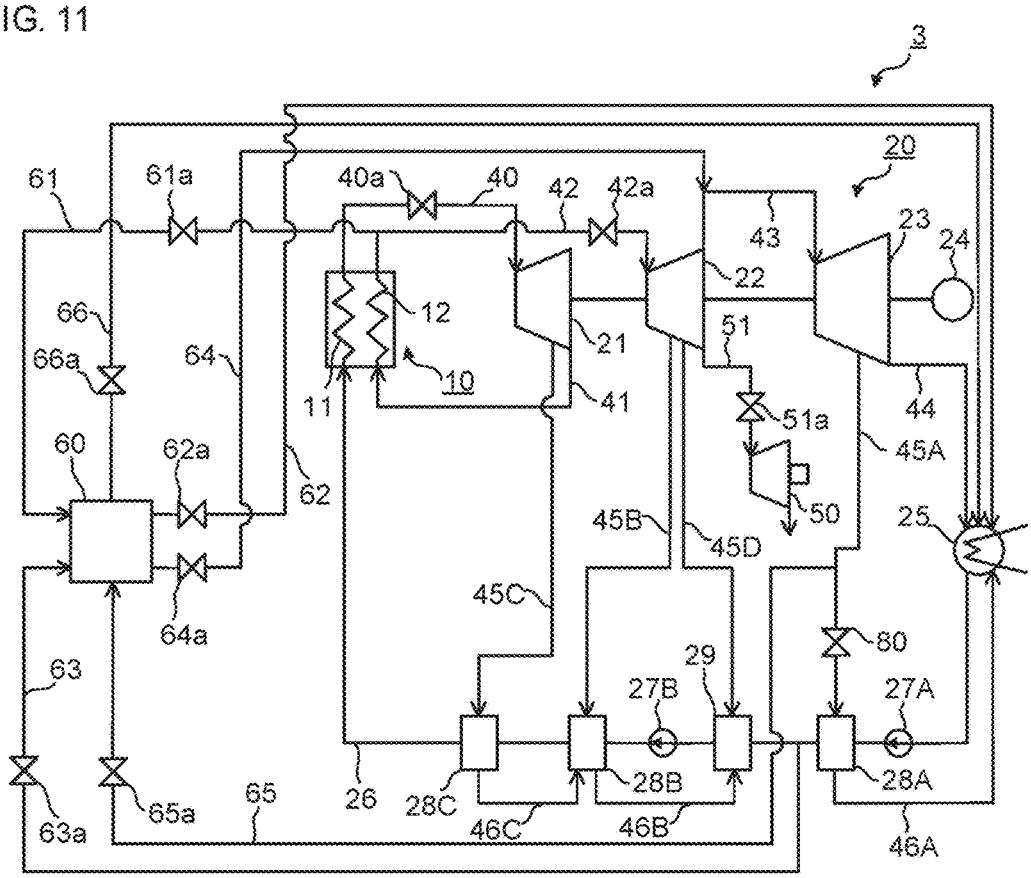
FIG. 11 is a system diagram schematically illustrating a configuration of a power generation facility in a third embodiment.

FIG. 11 is a system diagram schematically illustrating a configuration of a power generation facility 3 in a third embodiment. The configuration of the power generation facility 3 in the third embodiment is the same as that of the power generation facility 1 in the first embodiment illustrated in FIG. 2, except for the connection configuration of the steam supply pipe for heat storage 61 and the steam discharge pipe for heat storage 62.

Therefore, the configuration different from the configuration of the power generation facility 1 in the first embodiment is mainly explained here. The configuration of the steam generation function in the power generation facility 3 in the third embodiment illustrated in FIG. 11 is the aforementioned first steam generation structure.

Here, the configuration for exhibiting the heat storage function in the power generation facility 3 in the third embodiment illustrated in FIG. 11 is referred to as a third heat storage structure. The operation in the third heat storage structure is referred to as a third heat storage mode operation.

The third heat storage structure includes the heat storage and steam generation device 60, the steam supply pipe for heat storage 61, the steam discharge pipe for heat storage 62, and the drain pipe 66.

As illustrated in FIG. 11, in the third heat storage structure, one end of the steam supply pipe for heat storage 61 is connected to the high-temperature reheat steam pipe 42 between the reheat boiler 12 and the pressure and flow rate regulating valve 42*a*. One end of the steam discharge pipe for heat storage 62 is connected to the condenser 25.

During the third heat storage mode operation, the surplus steam is supplied from the high-temperature reheat steam pipe 42 to the heat storage and steam generation device 60 through the steam supply pipe for heat storage 61. Then, the surplus steam that has provided heat to the chemical heat storage material 72 by the aforementioned action is introduced into the condenser 25 through the steam discharge pipe for heat storage 62. The energy of the surplus steam to be supplied to the heat storage and steam generation device 60 through the steam supply pipe for heat storage 61 functions as surplus energy generated in the own system.

Further, including the first steam generation structure, the power generation facility 3 can obtain the same effects as those obtained by including the aforementioned first steam generation structure.

According to the power generation facility 3 in the third embodiment, including the heat storage and steam generation device 60 makes it possible to obtain the same effects as those in the power generation facility 1 in the first embodiment. That is, the power generation facility 3 in the third embodiment can reach the required load in a short period of time and obtain excellent responsiveness to the load increase.

Other Forms in the Third Embodiment

Figure 12:
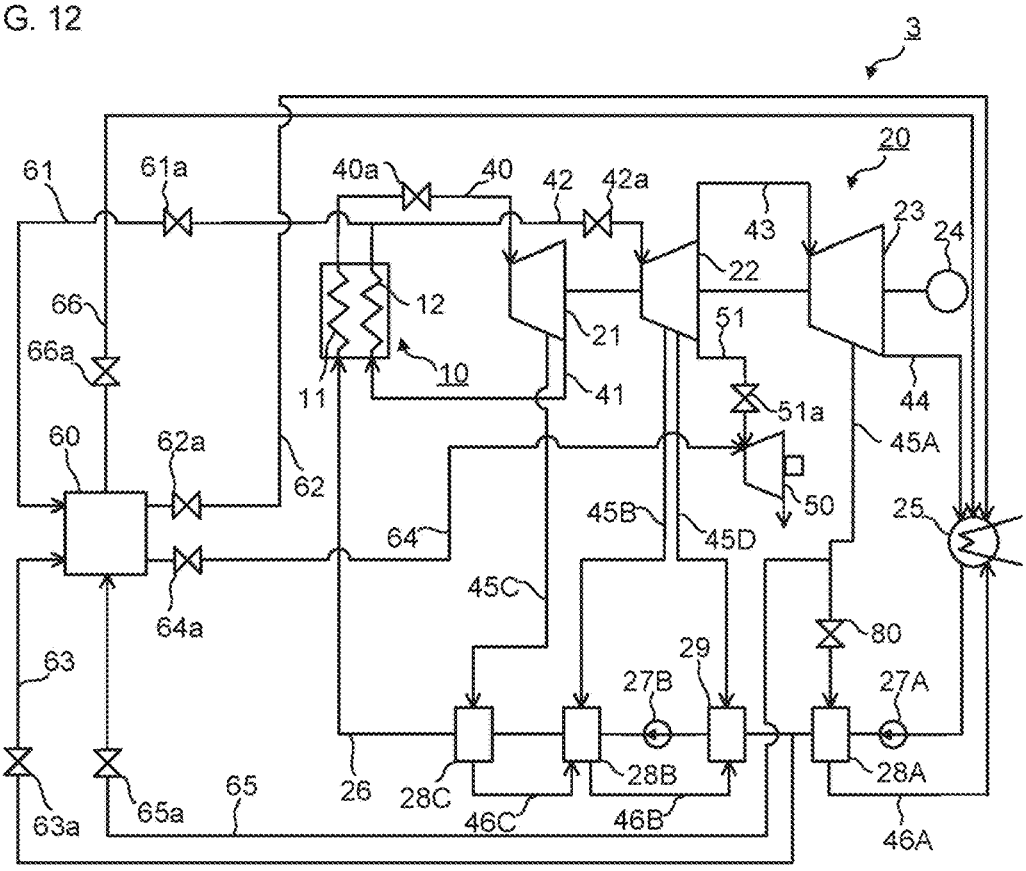
FIG. 12 is a system diagram schematically illustrating another form in the power generation facility in the third embodiment.
Figure 13:
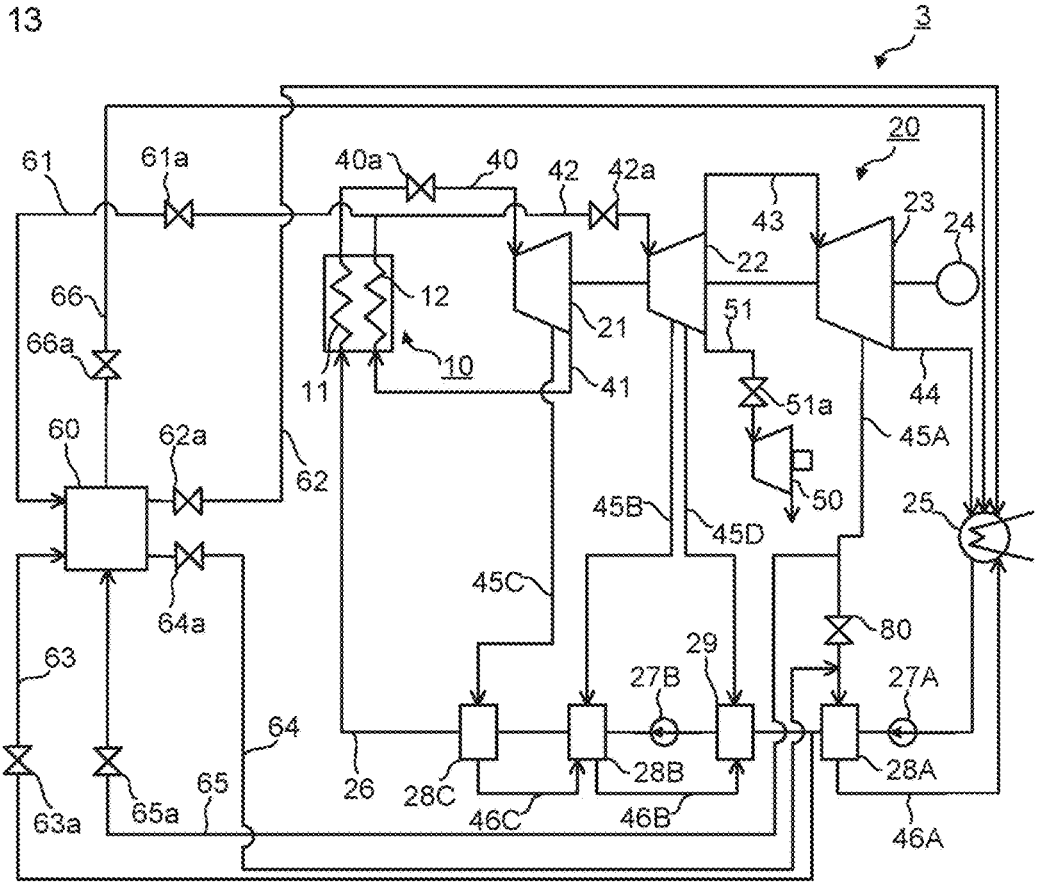
FIG. 13 is a system diagram schematically illustrating another form in the power generation facility in the third embodiment.

FIG. 12 and FIG. 13 each are a system diagram schematically illustrating another form in the power generation facility 3 in the third embodiment. In the forms illustrated in FIG. 12 and FIG. 13, the own system to which the steam generated in the heat storage and steam generation device 60 is supplied is different in the steam generation mode operation.

The configuration of the steam generation function in the form illustrated in FIG. 12 is the aforementioned second steam generation structure and performs the second steam generation mode operation. Therefore, it is possible to obtain the same effects as those obtained by including the aforementioned second steam generation structure. That is, the form illustrated in FIG. 12 can reach the required load in a short period of time and obtain excellent responsiveness to the load increase.

The configuration of the steam generation function in the form illustrated in FIG. 13 is the aforementioned third steam generation structure and performs the third steam generation mode operation. Therefore, it is possible to obtain the same effects as those obtained by including the aforementioned third steam generation structure. That is, the form illustrated in FIG. 13 can reach the required load in a short period of time and obtain excellent responsiveness to the load increase.

Fourth Embodiment

Figure 14:
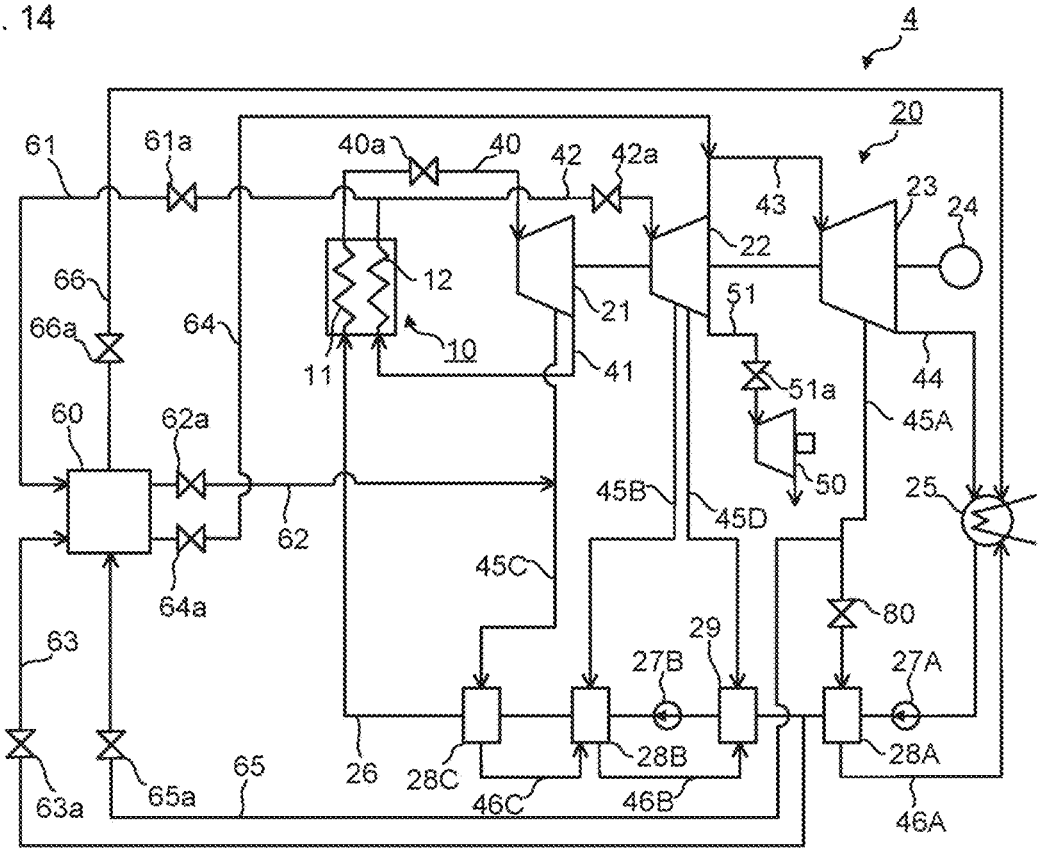
FIG. 14 is a system diagram schematically illustrating a configuration of a power generation facility in a fourth embodiment.

FIG. 14 is a system diagram schematically illustrating a configuration of a power generation facility 4 in a fourth embodiment. The configuration of the power generation facility 4 in the fourth embodiment is the same as that of the power generation facility 1 in the first embodiment illustrated in FIG. 2, except for the connection configuration of the steam supply pipe for heat storage 61 and the steam discharge pipe for heat storage 62.

Therefore, the configuration different from the configuration of the power generation facility 1 in the first embodiment is mainly explained here. The configuration of the steam generation function in the power generation facility 4 in the fourth embodiment illustrated in FIG. 14 is the aforementioned first steam generation structure.

Here, the configuration for exhibiting the heat storage function in the power generation facility 4 in the fourth embodiment illustrated in FIG. 14 is referred to as a fourth heat storage structure. The operation in the fourth heat storage structure is referred to as a fourth heat storage mode operation.

The fourth heat storage structure includes the heat storage and steam generation device 60, the steam supply pipe for heat storage 61, the steam discharge pipe for heat storage 62, and the drain pipe 66.

As illustrated in FIG. 14, in the fourth heat storage structure, one end of the steam supply pipe for heat storage 61 is connected to the high-temperature reheat steam pipe 42 between the reheat boiler 12 and the pressure and flow rate regulating valve 42*a*. One end of the steam discharge pipe for heat storage 62 is connected to the extraction steam pipe 45C. The example where one end of the steam discharge pipe for heat storage 62 is connected to the extraction steam pipe 45C has been explained here, but one end of the steam discharge pipe for heat storage 62 may be connected to the other extraction steam pipe 45B, 45D, or 45A, for example. For example, the extraction steam pipe 45B, 45C, 45D, or 45A to which one end of the steam discharge pipe for heat storage 62 is connected may be set based on the temperature of the steam supplied from the steam discharge pipe for heat storage 62.

During the fourth heat storage mode operation, the surplus steam is supplied from the high-temperature reheat steam pipe 42 to the heat storage and steam generation device 60 through the steam supply pipe for heat storage 61. Then, the surplus steam that has provided heat to the chemical heat storage material 72 by the aforementioned action is introduced into the extraction steam pipe 45C through the steam discharge pipe for heat storage 62. Thereby, the temperature of the feedwater rises, and the cycle thermal efficiency during the fourth heat storage mode operation is improved. The energy of the surplus steam to be supplied to the heat storage and steam generation device 60 through the steam supply pipe for heat storage 61 functions as surplus energy generated in the own system.

Further, including the first steam generation structure, the power generation facility 4 can obtain the same effects as those obtained by including the aforementioned first steam generation structure.

According to the power generation facility 4 in the fourth embodiment, including the heat storage and steam generation device 60 makes it possible to obtain the same effects as those in the power generation facility 1 in the first embodiment. That is, the power generation facility 4 in the fourth embodiment can reach the required load in a short period of time and obtain excellent responsiveness to the load increase.

Other Forms in the Fourth Embodiment

Figure 15:
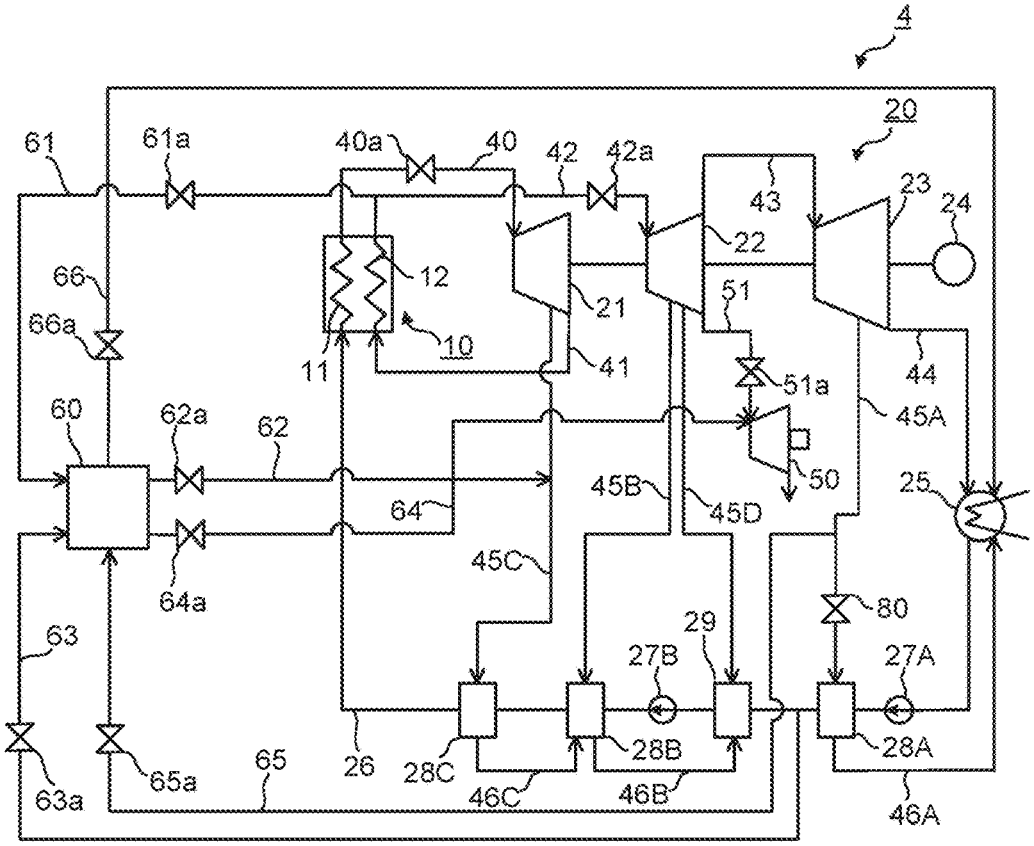
FIG. 15 is a system diagram schematically illustrating another form in the power generation facility in the fourth embodiment.
Figure 16:
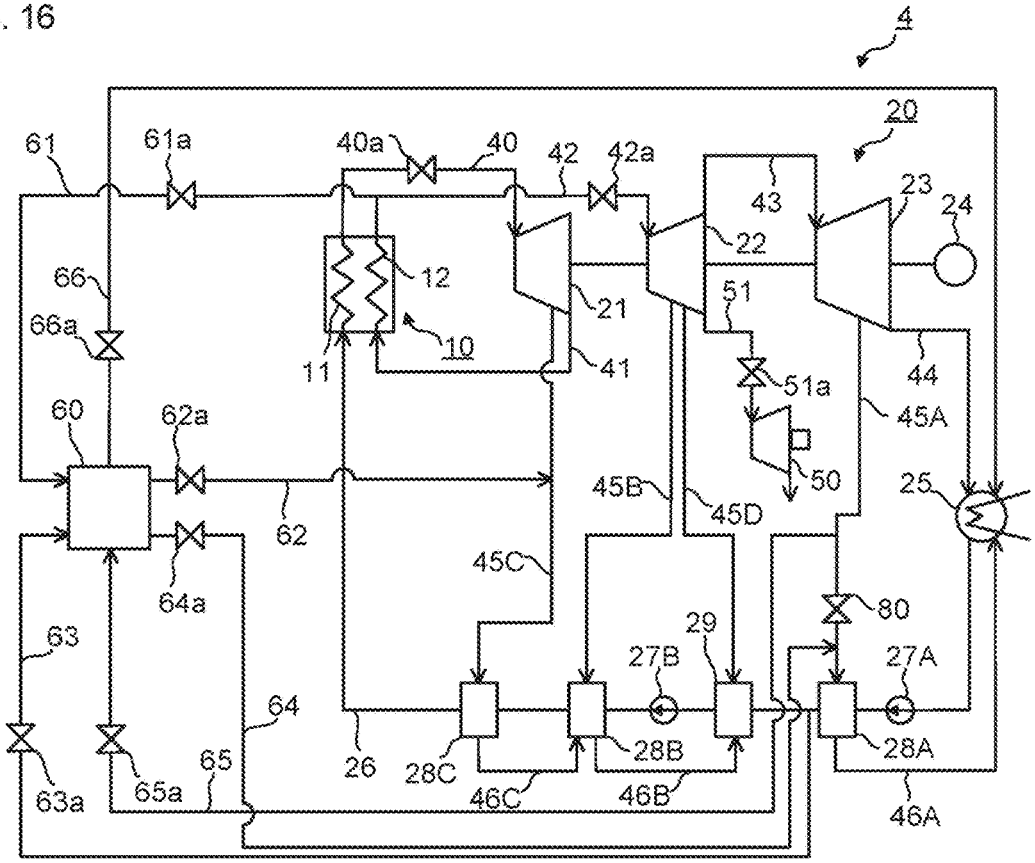
FIG. 16 is a system diagram schematically illustrating another form in the power generation facility in the fourth embodiment.

FIG. 15 and FIG. 16 each are a system diagram schematically illustrating another form in the power generation facility 4 in the fourth embodiment. In the forms illustrated in FIG. 15 and FIG. 16, the own system to which the steam generated in the heat storage and steam generation device 60 is supplied is different in the steam generation mode operation.

The configuration of the steam generation function in the form illustrated in FIG. 15 is the aforementioned second steam generation structure and performs the second steam generation mode operation. Therefore, it is possible to obtain the same effects as those obtained by including the aforementioned second steam generation structure. That is, the form illustrated in FIG. 15 can reach the required load in a short period of time and obtain excellent responsiveness to the load increase.

The configuration of the steam generation function in the form illustrated in FIG. 16 is the aforementioned third steam generation structure and performs the third steam generation mode operation. Therefore, it is possible to obtain the same effects as those obtained by including the aforementioned third steam generation structure. That is, the form illustrated in FIG. 16 can reach the required load in a short period of time and obtain excellent responsiveness to the load increase.

Fifth Embodiment

Figure 17:
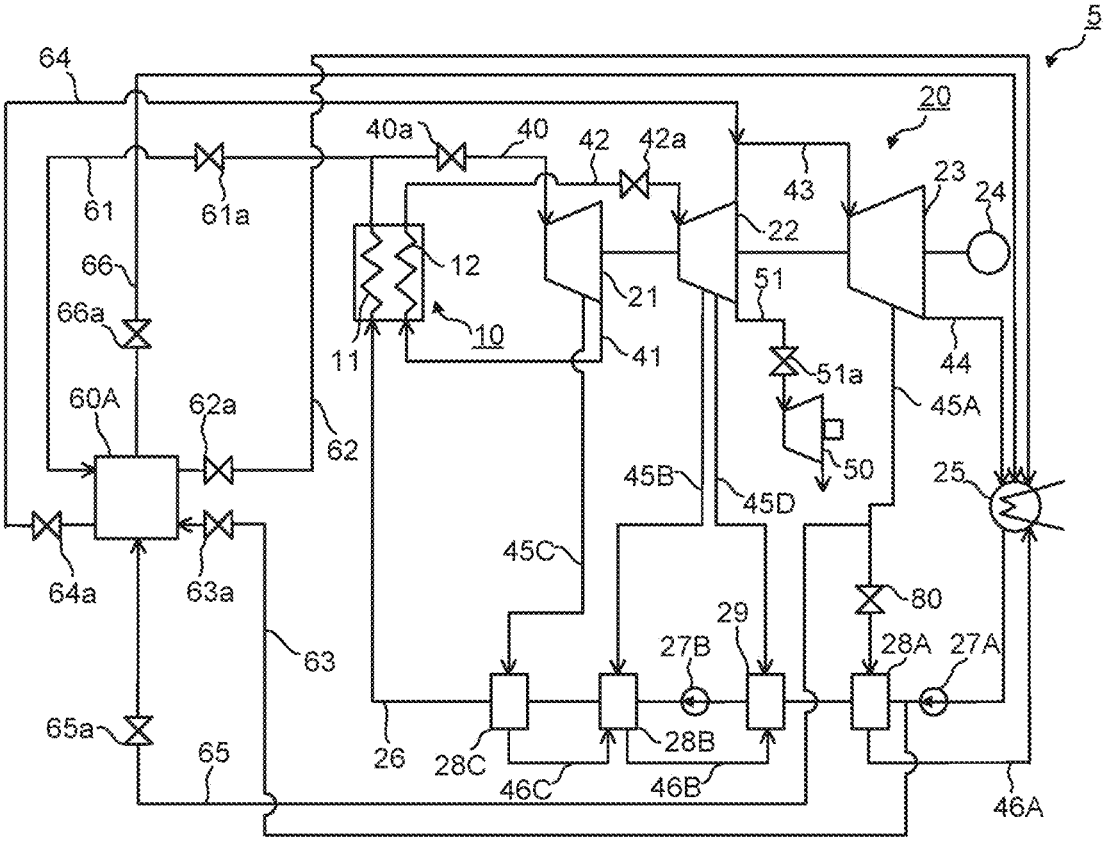
FIG. 17 is a system diagram schematically illustrating a configuration of a power generation facility in a fifth embodiment.
Figure 18:
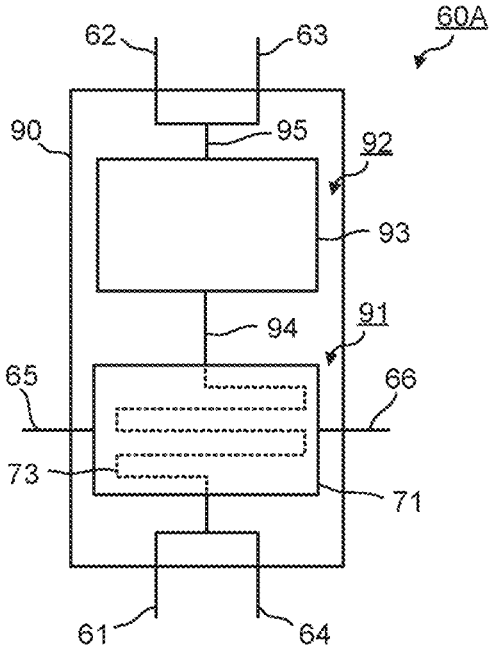
FIG. 18 is a diagram schematically illustrating an internal configuration of a heat storage and steam generation device in the power generation facility in the fifth embodiment.

FIG. 17 is a system diagram schematically illustrating a configuration of a power generation facility 5 in a fifth embodiment. FIG. 18 is a diagram schematically illustrating an internal configuration of a heat storage and steam generation device 60A in the power generation facility 5 in the fifth embodiment.

The configuration of the power generation facility 5 in the fifth embodiment is the same as that of the power generation facility 1 in the first embodiment illustrated in FIG. 2, except for the connection configuration of the heat storage and steam generation device 60A and the steam discharge pipe for heat storage 62. Therefore, the configuration different from the configuration of the power generation facility 1 in the first embodiment is mainly explained here.

Here, the configuration for exhibiting the heat storage function in the power generation facility 5 in the fifth embodiment illustrated in FIG. 17 is referred to as a fifth heat storage structure, and the configuration for exhibiting the steam generation function is referred to as a fourth steam generation structure. Further, the operation in the fifth heat storage structure is referred to as a fifth heat storage mode operation, and the operation in the fourth steam generation structure is referred to as a fourth steam generation mode operation.

The fifth heat storage structure includes the heat storage and steam generation device 60A, the steam supply pipe for heat storage 61, the steam discharge pipe for heat storage 62, and the drain pipe 66. The fourth steam generation structure includes the heat storage and steam generation device 60A, the feedwater supply pipe for steam generation 63, the steam supply pipe 64, and the water supply pipe for heat storage material 65.

As illustrated in FIG. 17, in the fifth heat storage structure, one end of the steam discharge pipe for heat storage 62 is connected to the condenser 25. Further, in the fourth steam generation structure, an example is explained in which one end of the feedwater supply pipe for steam generation 63 is connected to the feed pipe 26 between the feed pump 27A and the feedwater heater 28A.

As illustrated in FIG. 18, the heat storage and steam generation device 60A includes a device container 90, a heat storage and steam generation unit 91 including a chemical heat storage material, and a heat storage and steam generation unit 92 including a latent heat storage material or a sensible heat storage material. The configuration of the heat storage and steam generation unit 91 including the chemical heat storage material is the same as the configuration inside the inner container 71 of the heat storage and steam generation device 60 explained with reference to FIG. 3.

The device container 90 is made of a casing and houses the heat storage and steam generation unit 91 and the heat storage and steam generation unit 92.

The heat storage and steam generation unit 92 includes an inner container 93 filled with the latent heat storage material or the sensible heat storage material. The latent heat storage material is a heat storage material that stores heat using a phase change of a substance. The latent heat storage material is formed of, for example, an outer shell (shell) or container made of resin or other materials filled with a latent heat storage substance. In this case, the latent heat storage material exchanges heat with a fluid flowing through a space between the latent heat storage materials.

Here, the surplus steam obtained after the heat has been given to the heat storage and steam generation unit 91 is supplied to the heat storage and steam generation unit 92. Therefore, the temperature of the surplus steam to be supplied to the heat storage and steam generation unit 92 is lower than the temperature of the surplus steam to be supplied to the heat storage and steam generation unit 91.

As the latent heat storage substance, a substance that undergoes a phase change in a predetermined temperature range (for example, 250 to 350° C.) is used. Examples of the latent heat storage substance include an alloy PCM (Phase Change Material), a molten salt, water, polyethylene, sugar alcohols such as erythritol and mannitol, paraffin, and so on.

The sensible heat storage material is a heat storage material that stores heat using a temperature change of a substance. Examples of the sensible heat storage material include rock, concrete, ceramic, and so on. The sensible heat storage material filled in the inner container 93 exchanges heat with a fluid flowing through a space between the sensible heat storage materials.

Here, in the heat storage and steam generation unit 91, at one end side of the heat exchange pipe 73, one branch is connected to the steam supply pipe for heat storage 61 and the other branch is connected to the steam supply pipe 64. The other end of the heat exchange pipe 73 is connected to a connecting pipe 94. The connecting pipe 94 connects the heat storage and steam generation unit 91 and the heat storage and steam generation unit 92. Further, the connecting pipe 94 communicates with the inside of the inner container 93.

Further, a pipe 95 is provided on the side of the heat storage and steam generation unit 92, which is opposite to the side connected to the connecting pipe 94. The other end of the pipe 95 is branched into two branches. One branch is connected to the steam discharge pipe for heat storage 62 and the other branch is connected to the feedwater supply pipe for steam generation 63.

As above, the heat storage and steam generation unit 91 is located on the side of the steam supply pipe for heat storage 61 that supplies high-temperature steam during the fifth heat storage mode operation, and on the side of the steam supply pipe 64 that supplies steam generated during the fourth steam generation mode operation. On the other hand, the heat storage and steam generation unit 92 is located on the side of the steam discharge pipe for heat storage 62 that discharges surplus steam that has provided heat to the chemical heat storage material 72 during the fifth heat storage mode operation, and on the side of the feedwater supply pipe for steam generation 63 that supplies feedwater intended for generating steam during the fourth steam generation mode operation.

Here, the example where the heat storage and steam generation unit 91 and the heat storage and steam generation unit 92 are provided inside the device container 90 being one container has been explained, but the present invention is not limited to this configuration. The heat storage and steam generation unit 91 and the heat storage and steam generation unit 92 do not need to be arranged in one container, and may be arranged independently of each other. In this case as well, the heat storage and steam generation unit 91 and the heat storage and steam generation unit 92 are connected by the connecting pipe 94 as described above.

(Action of the Heat Storage and Steam Generation Device 60A: During the Fifth Heat Storage Mode Operation)

Next, the action of the heat storage and steam generation device 60A during the fifth heat storage mode operation is explained with reference to FIG. 17 and FIG. 18. As mentioned above, during the fifth heat storage mode operation, the surplus energy is stored in the heat storage and steam generation device 60A.

During the fifth heat storage mode operation, the surplus steam generated in the boiler 11 is introduced from the main steam pipe 40 into the heat exchange pipe 73 of the heat storage and steam generation unit 91 through the steam supply pipe for heat storage 61. The energy of the surplus steam to be supplied to the heat storage and steam generation device 60A through the steam supply pipe for heat storage 61 functions as surplus energy generated in the own system. As has been explained with reference to FIG. 3, the surplus steam introduced into the heat exchange pipe 73 heats the chemical heat storage material 72. The chemical heat storage material 72 stores heat by a dehydration reaction. The water produced by the dehydration reaction is discharged to the condenser 25 through the drain pipe 66.

Then, the surplus steam that has provided heat to the chemical heat storage material 72 is introduced into the inner container 93 of the heat storage and steam generation unit 92 through the connecting pipe 94. The surplus steam introduced into the inner container 93 gives heat to the latent heat storage material or the sensible heat storage material. This allows the latent heat storage material or the sensible heat storage material to store heat.

The surplus steam that has provided heat to the latent heat storage material or the sensible heat storage material is introduced into the condenser 25 through the steam discharge pipe for heat storage 62.

(Action of the Heat Storage and Steam Generation Device 60A: During the Fourth Steam Generation Mode Operation)

Next, the action of the heat storage and steam generation device 60A during the fourth steam generation mode operation is explained with reference to FIG. 17 and FIG. 18.

As mentioned above, during the evening when the supply of renewable energy decreases, a load increase request is made for the steam power generation facility. In the steam generation mode operation, when the load increase request is made, steam is generated using the stored heat, and the generated steam is used in the own system.

During the fourth steam generation mode operation, the feedwater supplied from the feedwater supply pipe for steam generation 63 to the heat storage and steam generation unit 92 through the pipe 95 is heated by the heat stored in the latent heat storage material or the sensible heat storage material. The heated feedwater is supplied to the heat exchange pipe 73 through the connecting pipe 94 in the form of steam or water.

Here, the extraction steam from the extraction steam pipe 45A is supplied to the chemical heat storage material 72 through the water supply pipe for heat storage material 65. As has been explained with reference to FIG. 3, the chemical heat storage material 72 releases heat by a hydration reaction.

The steam or water supplied to the heat exchange pipe 73 is heated by the released heat of the chemical heat storage material 72 to become superheated steam. The steam generated in the heat storage and steam generation unit 91 is supplied to the crossover pipe 43 through the steam supply pipe 64, for example. The steam supplied to the crossover pipe 43 is introduced into the low-pressure turbine 23 together with the steam discharged from the intermediate-pressure turbine 22. Therefore, the amount of steam to be introduced into the low-pressure turbine 23 increases and the turbine output increases.

According to the power generation facility 5 in the fifth embodiment, including the heat storage and steam generation device 60A makes it possible to obtain the same effects as those in the power generation facility 1 in the first embodiment. That is, the power generation facility 5 in the fifth embodiment can reach the required load in a short period of time and obtain excellent responsiveness to the load increase.

Including the latent heat storage material or the sensible heat storage material in addition to the chemical heat storage material 72 makes it possible to store the heat of the surplus steam that has provided heat to the chemical heat storage material 72 in the latent heat storage material or the sensible heat storage material during the fifth heat storage mode operation. As a result, the heat that the surplus steam has can be effectively stored.

Further, during the fourth steam generation mode operation, the feedwater is heated by the heat that the latent heat storage material or the sensible heat storage material has, and then is heated by the heat that the chemical heat storage material 72 has, thereby making it possible to increase the amount of steam generated. Further, during the fourth steam generation mode operation, the low-temperature feedwater supplied through the feedwater supply pipe for steam generation 63 is heated by the heat that the latent heat storage material or the sensible heat storage material has, and thereby, it is possible to reduce the amount of extraction steam to be supplied to heat the low-temperature feedwater by, for example, the feedwater heater 28A or the like. Examples of the low-temperature feedwater include the feedwater supplied from the feed pipe 26 between the feed pump 27A and the feedwater heater 28A, and so on. Thereby, the amount of the extraction steam from, for example, the low-pressure turbine 23 decreases and the responsiveness to the load increase improves.

Here, the power generation facility 5 in the fifth embodiment may have a configuration not including the intermediate-pressure turbine 22. As has been explained with reference to FIG. 8, the configuration not including the intermediate-pressure turbine 22 results in the configuration obtained by removing the intermediate-pressure turbine 22, the reheat boiler 12, the low-temperature reheat steam pipe 41, and the high-temperature reheat steam pipe 42 from the configuration illustrated in FIG. 17. In this case as well, the same effects as those in the power generation facility 5 illustrated in FIG. 17 can be obtained.

Other forms in the Fifth Embodiment

Figure 19:
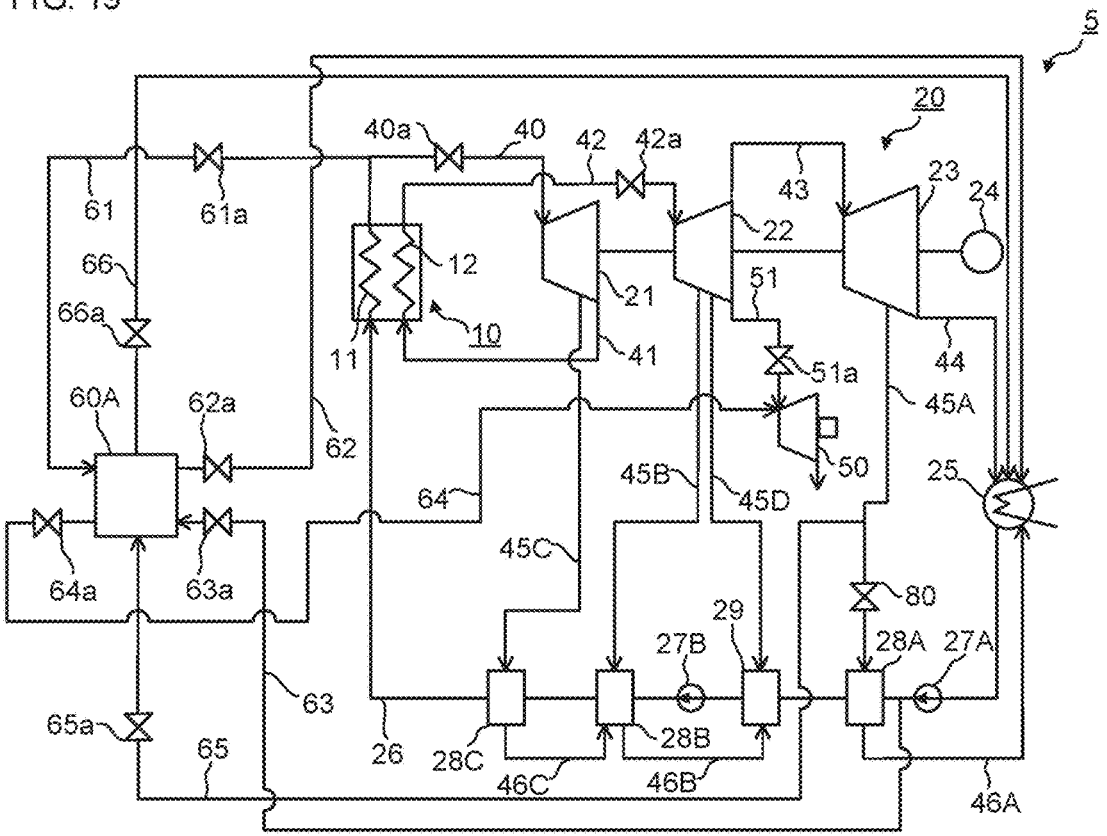
FIG. 19 is a system diagram schematically illustrating another form in the power generation facility in the fifth embodiment.
Figure 20:
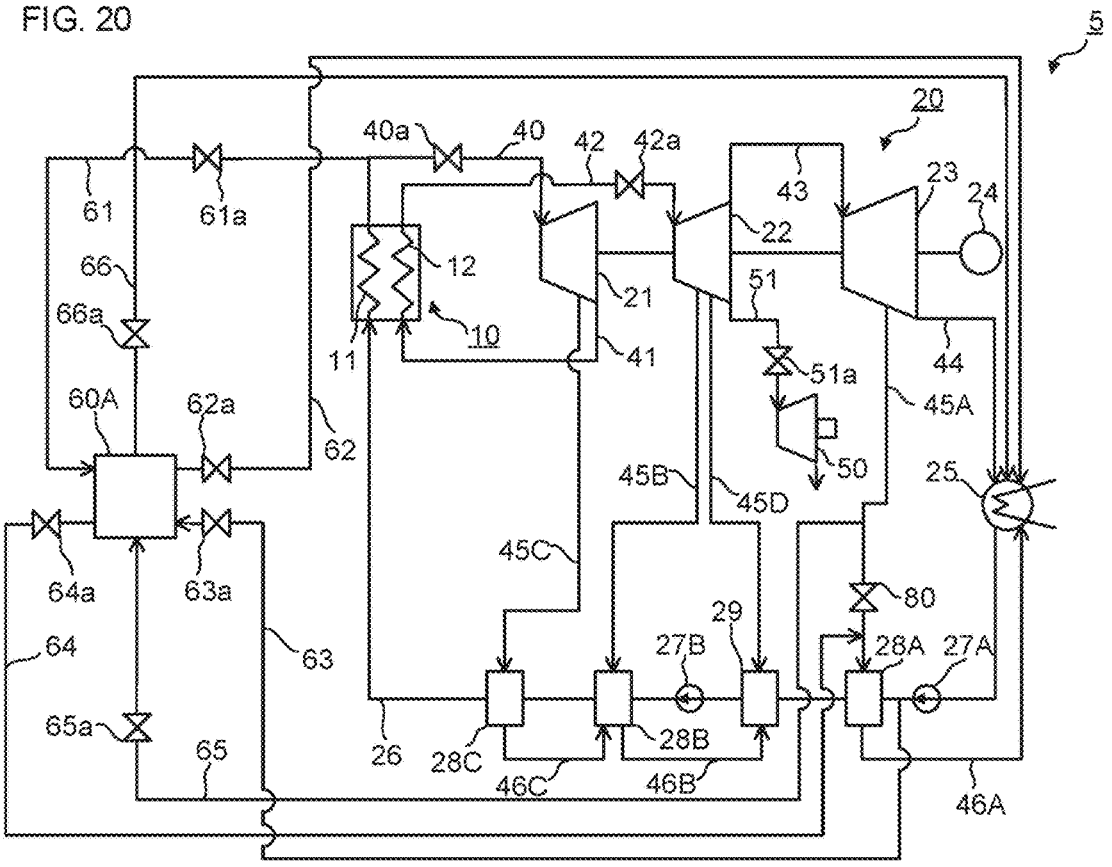
FIG. 20 is a system diagram schematically illustrating another form in the power generation facility in the fifth embodiment.

FIG. 19 and FIG. 20 each are a system diagram schematically illustrating another form in the power generation facility 5 in the fifth embodiment. In the forms illustrated in FIG. 19 and FIG. 20, the own system to which the steam generated in the heat storage and steam generation device 60A is supplied is different in the steam generation mode operation.

Here, the configuration for exhibiting the steam generation function in the form illustrated in FIG. 19 is referred to as a fifth steam generation structure. The operation in the fifth steam generation structure is referred to as a fifth steam generation mode operation. Further, the configuration for exhibiting the steam generation function in the form illustrated in FIG. 20 is referred to as a sixth steam generation structure. The operation in the sixth steam generation structure is referred to as a sixth steam generation mode operation.

The fifth steam generation structure and the sixth steam generation structure each include the heat storage and steam generation device 60A, the feedwater supply pipe for steam generation 63, the steam supply pipe 64, and the water supply pipe for heat storage material 65.

During the fifth steam generation mode operation and during the sixth steam generation mode operation, the action of generating superheated steam from feedwater is the same as that during the above-described fourth steam generation mode operation.

As illustrated in FIG. 19, in the fifth steam generation structure, one end of the steam supply pipe 64 is connected to the steam inlet of the feed pump drive turbine 50. During the fifth steam generation mode operation, the superheated steam generated in the heat storage and steam generation device 60A is supplied to the feed pump drive turbine 50 through the steam supply pipe 64. At this time, the flow rate regulating valve 51*a* of the steam supply pipe 51 is closed. Therefore, the steam discharged from the intermediate-pressure turbine 22 is introduced into the low-pressure turbine 23 through the crossover pipe 43.

As above, the steam, which has been supplied to the feed pump drive turbine 50, is to be introduced into the low-pressure turbine 23, and thus the turbine output increases. This also allows the form illustrated in FIG. 19 to reach the required load in a short period of time and obtain excellent responsiveness to the load increase.

As illustrated in FIG. 20, in the sixth steam generation structure, one end of the steam supply pipe 64 is connected to the extraction steam pipe 45A. One end of the steam supply pipe 64 is connected to the side of the feedwater heater 28A relative to the position where the flow rate regulating valve 80 is provided.

During the sixth steam generation mode operation, the superheated steam generated in the heat storage and steam generation device 60A is supplied to the extraction steam pipe 45A through the steam supply pipe 64. At this time, the flow rate regulating valve 80 is closed. The amount of extraction steam from the low-pressure turbine 23 results in the amount of the steam to be supplied to the heat storage and steam generation device 60A through the water supply pipe for heat storage material 65. Therefore, the amount of extraction steam from the low-pressure turbine 23 decreases and thus the turbine output increases. This also allows the form illustrated in FIG. 20 to reach the required load in a short period of time and obtain excellent responsiveness to the load increase.

Sixth Embodiment

Figure 21:
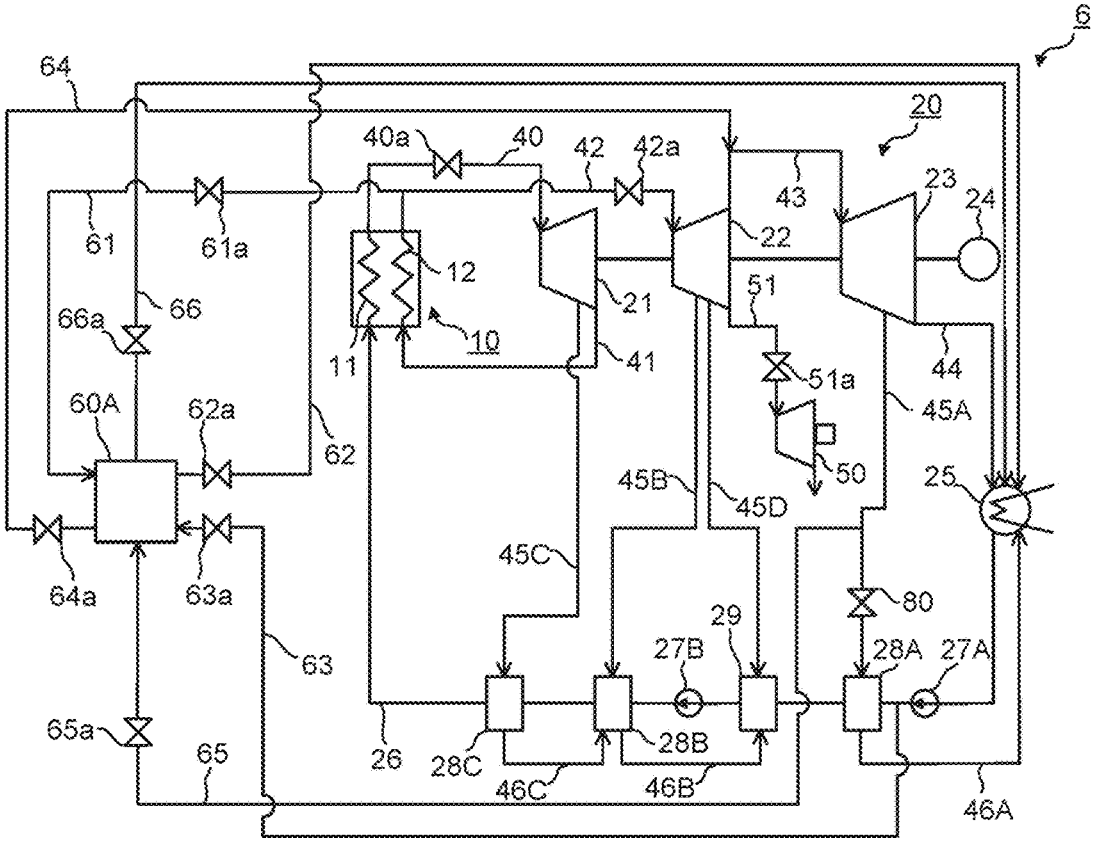
FIG. 21 is a system diagram schematically illustrating a configuration of a power generation facility in a sixth embodiment.

FIG. 21 is a system diagram schematically illustrating a configuration of a power generation facility 6 in a sixth embodiment. The configuration of the power generation facility 6 in the sixth embodiment is the same as that of the power generation facility 5 in the fifth embodiment illustrated in FIG. 17 except for the connection configuration of the steam supply pipe for heat storage 61. Therefore, the configuration different from the configuration of the power generation facility 5 in the fifth embodiment is mainly explained here.

The configuration of the steam generation function in the power generation facility 6 in the sixth embodiment illustrated in FIG. 21 is the aforementioned fourth steam generation structure.

Here, the configuration for exhibiting the heat storage function in the power generation facility 6 in the sixth embodiment illustrated in FIG. 21 is referred to as a sixth heat storage structure. The operation in the sixth heat storage structure is referred to as a sixth heat storage mode operation.

The sixth heat storage structure includes the heat storage and steam generation device 60A, the steam supply pipe for heat storage 61, the steam discharge pipe for heat storage 62, and the drain pipe 66.

As illustrated in FIG. 21, in the sixth heat storage structure, one end of the steam supply pipe for heat storage 61 is connected to the high-temperature reheat steam pipe 42 between the reheat boiler 12 and the pressure and flow rate regulating valve 42*a*.

During the sixth heat storage mode operation, the surplus steam is supplied from the high-temperature reheat steam pipe 42 to the heat storage and steam generation device 60A through the steam supply pipe for heat storage 61. Then, the surplus steam that has provided heat to the heat storage and steam generation unit 91 and the heat storage and steam generation unit 92 by the aforementioned action is introduced into the condenser 25 through the steam discharge pipe for heat storage 62. The energy of the surplus steam to be supplied to the heat storage and steam generation device 60A through the steam supply pipe for heat storage 61 functions as surplus energy generated in the own system.

Further, including the fourth steam generation structure, the power generation facility 6 can obtain the same effects as those obtained by including the fourth steam generation structure explained in the fifth embodiment.

According to the power generation facility 6 in the sixth embodiment, including the heat storage and steam generation device 60A makes it possible to obtain the same effects as those in the power generation facility 5 in the fifth embodiment. That is, the power generation facility 6 in the sixth embodiment can reach the required load in a short period of time and obtain excellent responsiveness to the load increase.

Further, the heat storage and steam generation device 60A includes the latent heat storage material or the sensible heat storage material in addition to the chemical heat storage material 72, thereby allowing the latent heat storage material or the sensible heat storage material to store the heat of the surplus steam that has provided heat to the chemical heat storage material 72 during the sixth heat storage mode operation. This makes it possible to effectively store the heat that the surplus steam has.

Other Forms in the Sixth Embodiment

Figure 22:
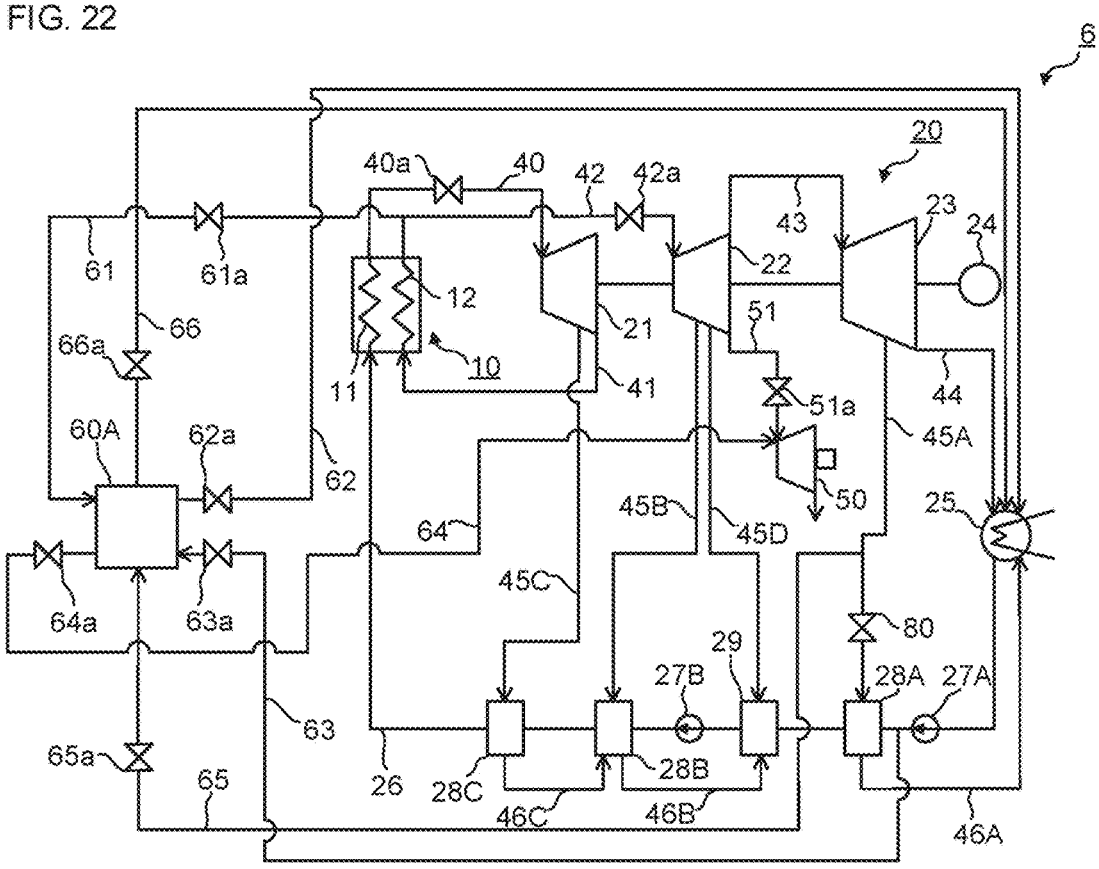
FIG. 22 is a system diagram schematically illustrating another form in the power generation facility in the sixth embodiment.
Figure 23:
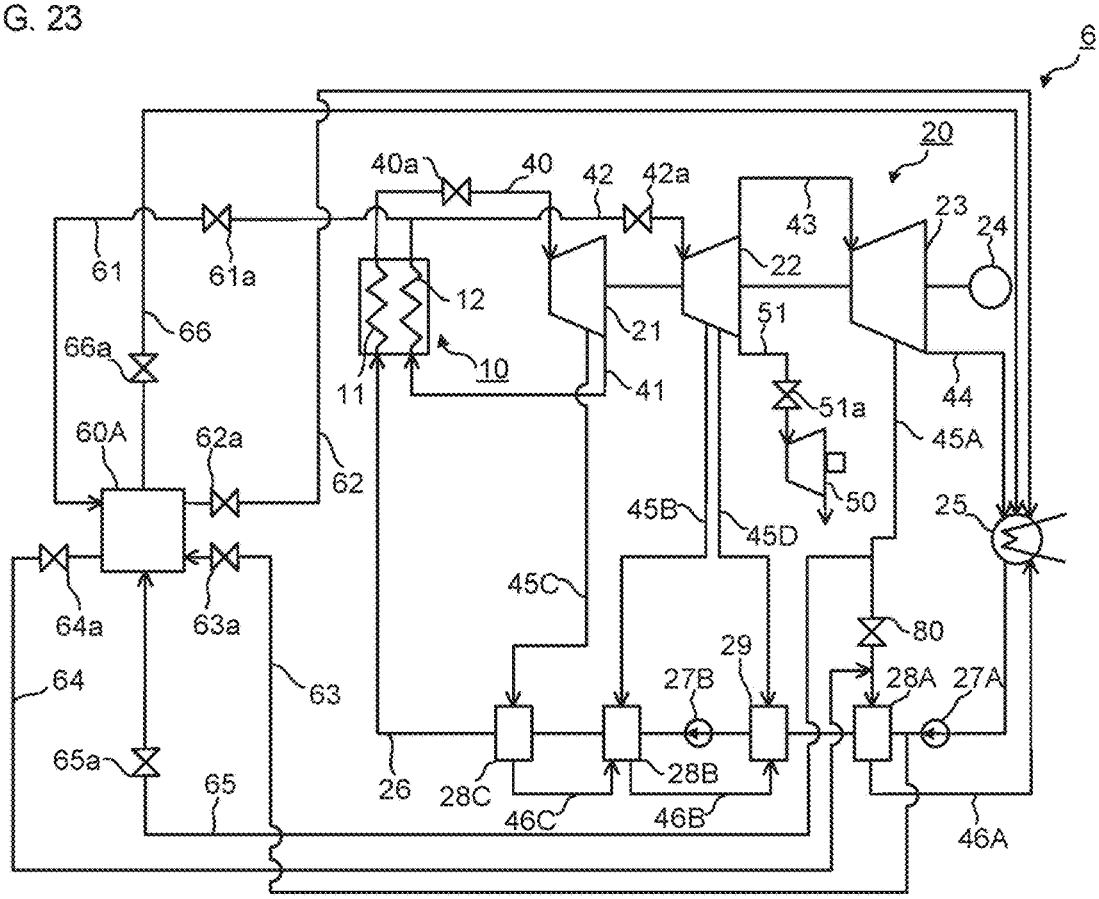
FIG. 23 is a system diagram schematically illustrating another form in the power generation facility in the sixth embodiment.

FIG. 22 and FIG. 23 each are a system diagram schematically illustrating another form in the power generation facility 6 in the sixth embodiment. In the forms illustrated in FIG. 22 and FIG. 23, the own system to which the steam generated in the heat storage and steam generation device 60A is supplied is different in the steam generation mode operation.

The configuration of the steam generation function in the form illustrated in FIG. 22 is the aforementioned fifth steam generation structure and performs the fifth steam generation mode operation. Therefore, it is possible to obtain the same effects as those obtained by including the aforementioned fifth steam generation structure. That is, the form illustrated in FIG. 22 can reach the required load in a short period of time and obtain excellent responsiveness to the load increase.

The configuration of the steam generation function in the form illustrated in FIG. 23 is the aforementioned sixth steam generation structure and performs the sixth steam generation mode operation. Therefore, it is possible to obtain the same effects as those obtained by including the aforementioned sixth steam generation structure. That is, the form illustrated in FIG. 23 can reach the required load in a short period of time and obtain excellent responsiveness to the load increase.

Seventh Embodiment

Figure 24:
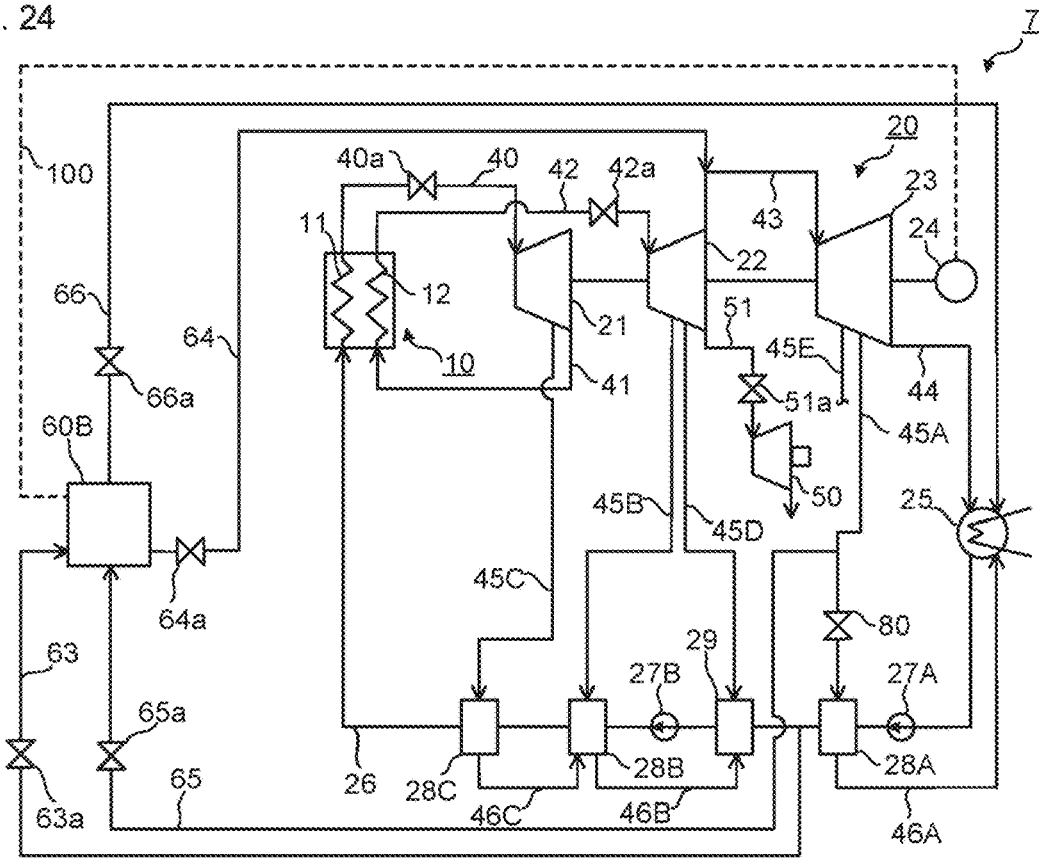
FIG. 24 is a system diagram schematically illustrating a configuration of a power generation facility in a seventh embodiment.
Figure 25:
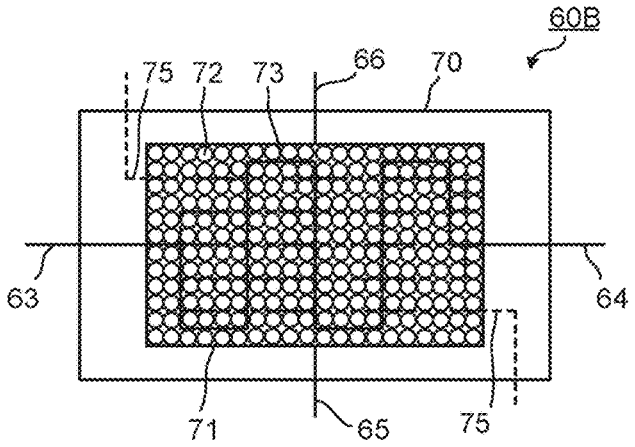
FIG. 25 is a diagram schematically illustrating an internal configuration of a heat storage and steam generation device in the power generation facility in the seventh embodiment.

FIG. 24 is a system diagram schematically illustrating a configuration of a power generation facility 7 in a seventh embodiment. FIG. 25 is a diagram schematically illustrating an internal configuration of a heat storage and steam generation device 60B in the power generation facility 7 in the seventh embodiment.

The configuration of the power generation facility 7 in the seventh embodiment is the same as that of the power generation facility 1 in the first embodiment illustrated in FIG. 2, except for the heat storage and steam generation device 60B, the seventh heat storage structure, and the seventh steam generation structure. Therefore, the configuration different from the configuration of the power generation facility 1 in the first embodiment is mainly explained here.

The heat storage and steam generation device 60B in the seventh embodiment has a heat storage function that uses surplus energy generated in an own system to store heat, and a steam generation function that has part of feedwater led by the feed pipe 26 introduced thereinto and turns the feedwater into steam by the stored heat. Then, in the heat storage and steam generation device 60B, surplus power is used as the surplus energy generated in the own system.

This surplus power is electric power generated by introducing the surplus steam generated in the boiler 11 into the steam turbine system 20. That is, the surplus power is the power equivalent to the surplus steam generated in the generator 24 by introducing the surplus steam into the steam turbine system 20.

Here, the configuration for exhibiting the heat storage function in the power generation facility 7 in the seventh embodiment illustrated in FIG. 24 is referred to as a seventh heat storage structure, and the configuration for exhibiting the steam generation function is referred to as a seventh steam generation structure. Further, the operation in the seventh heat storage structure is referred to as a seventh heat storage mode operation, and the operation in the seventh steam generation structure is referred to as a seventh steam generation mode operation.

The seventh heat storage structure includes the heat storage and steam generation device 60B, an electric power supply line 100, and the drain pipe 66. The seventh steam generation structure includes the heat storage and steam generation device 60B, the feedwater supply pipe for steam generation 63, the steam supply pipe 64, and the water supply pipe for heat storage material 65.

As illustrated in FIG. 24, in the seventh heat storage structure, a thermoelectric converter is used as a heat source for heat storage. Therefore, the system for supplying steam for heat storage to the heat storage and steam generation device 60B and the system for discharging steam for heat storage from the heat storage and steam generation device 60B are not provided. As a result, the steam containing surplus steam, which flows through the main steam pipe 40, is introduced into the high-pressure turbine 21 without being supplied to the heat storage and steam generation device 60B. Further, the steam containing surplus steam, which flows through the high-temperature reheat steam pipe 42, is introduced into the intermediate-pressure turbine 22 without being supplied to the heat storage and steam generation device 60B.

As illustrated in FIG. 25, the heat storage and steam generation device 60B includes the device container 70, the inner container 71, the chemical heat storage material 72, the heat exchange pipe 73, and a thermoelectric converter 75. In FIG. 25, the components that are the same as those of the heat storage and steam generation device 60 illustrated in FIG. 3 are denoted by the same reference numerals, and redundant explanations are omitted or simplified. In FIG. 25, the thermoelectric converter 75 is indicated by a dotted line, in order to distinguish it from the heat exchange pipe 73.

Inside the inner container 71, the thermoelectric converter 75 is arranged in a meandering manner. That is, the thermoelectric converter 75 is arranged to meander between the chemical heat storage materials 72 while being in contact with the chemical heat storage materials 72, similarly to the heat exchange pipe 73. The thermoelectric converter 75 is preferably arranged so as not to be in contact with the outer surface of the heat exchange pipe 73.

The thermoelectric converter 75 generates heat by electric power. The thermoelectric converter 75 is formed of, for example, an electric heater or the like. Both ends of the thermoelectric converter 75 function as terminals to which electric power is supplied. Both ends of the thermoelectric converter 75 protrude, for example, outside the inner container 71 and the device container 70 so as to enable supply of electric power. Further, both ends of the thermoelectric converter 75 are connected to the generator 24 via the electric power supply line 100. Then, the surplus power generated by the generator 24 is supplied to both ends of the thermoelectric converter 75. In FIG. 24, the electric power supply line 100 is indicated by a dotted line.

Since the heat storage and steam generation device 60B does not include the system for supplying steam for heat storage and the system for discharging steam for heat storage, one end of the heat exchange pipe 73 is connected to the feedwater supply pipe for steam generation 63, and the other end of the heat exchange pipe 73 is connected to the steam supply pipe 64.

(Action of the Heat Storage and Steam Generation Device 60B: During the Seventh Heat Storage Mode Operation)

Next, the action of the heat storage and steam generation device 60B during the seventh heat storage mode operation is explained with reference to FIG. 24 and FIG. 25. In the seventh heat storage mode operation, the surplus energy is stored in the heat storage and steam generation device 60B.

During the seventh heat storage mode operation, the flow rate regulating valve 63*a* of the feedwater supply pipe for steam generation 63 and the flow rate regulating valve 64*a* of the steam supply pipe 64 are closed. The flow rate regulating valve 65*a* of the water supply pipe for heat storage material 65 is closed, and the flow rate regulating valve 66*a* of the drain pipe 66 is opened.

The surplus power generated by the generator 24 is supplied to the thermoelectric converter 75 through the electric power supply line 100. The thermoelectric converter 75 generates heat by supplied electric power. The chemical heat storage material 72 is heated by this generated heat. Then, the chemical heat storage material 72 stores heat by a dehydration reaction. The water produced by the dehydration reaction is discharged to the condenser 25 through the drain pipe 66.

(Action of the Heat Storage and Steam Generation Device 60B: During the Seventh Steam Generation Mode Operation)

Next, the action of the heat storage and steam generation device 60B during the seventh steam generation mode operation is explained with reference to FIG. 24 and FIG. 25.

As mentioned above, during the evening when the supply of renewable energy decreases, a load increase request is made for the steam power generation facility. In the steam generation mode operation, when the load increase request is made, steam is generated using the stored heat, and the generated steam is used in the own system.

During the seventh steam generation mode operation, the flow rate regulating valve 63*a* of the feedwater supply pipe for steam generation 63 and the flow rate regulating valve 64*a* of the steam supply pipe 64 are opened. The flow rate regulating valve 65*a* of the water supply pipe for heat storage material 65 is opened and the flow rate regulating valve 66*a* of the drain pipe 66 is closed.

The extraction steam from the extraction steam pipe 45A is supplied to the chemical heat storage material 72 through the water supply pipe for heat storage material 65. As mentioned above, the chemical heat storage material 72 releases heat by a hydration reaction.

The feedwater supplied to the heat exchange pipe 73 through the feedwater supply pipe for steam generation 63 is heated by the released heat of the chemical heat storage material 72 to become superheated steam. The steam generated in the heat storage and steam generation device 60B is supplied to, for example, the crossover pipe 43 through the steam supply pipe 64. The steam supplied to the crossover pipe 43 is introduced into the low-pressure turbine 23 together with the steam discharged from the intermediate-pressure turbine 22. Therefore, the amount of steam to be introduced into the low-pressure turbine 23 increases and the turbine output increases.

According to the power generation facility 7 in the seventh embodiment, including the heat storage and steam generation device 60B provided with the thermoelectric converter 75 makes it possible to store heat using surplus power. Further, the power generation facility 7 includes the heat storage and steam generation device 60B, and thereby, the same effects as those in the power generation facility 1 in the first embodiment can be obtained. That is, the power generation facility 7 in the seventh embodiment can reach the required load in a short period of time and obtain excellent responsiveness to the load increase.

Here, the power generation facility 7 in the seventh embodiment may have a configuration not including the intermediate-pressure turbine 22. The configuration not including the intermediate-pressure turbine 22 is as explained with reference to FIG. 8, and results in the configuration obtained by removing the intermediate-pressure turbine 22, the reheat boiler 12, the low-temperature reheat steam pipe 41, and the high-temperature reheat steam pipe 42 from the configuration illustrated in FIG. 24. In this case as well, the same effects as those in the power generation facility 5 illustrated in FIG. 24 can be obtained.

Other Forms in the Seventh Embodiment

Figure 26:
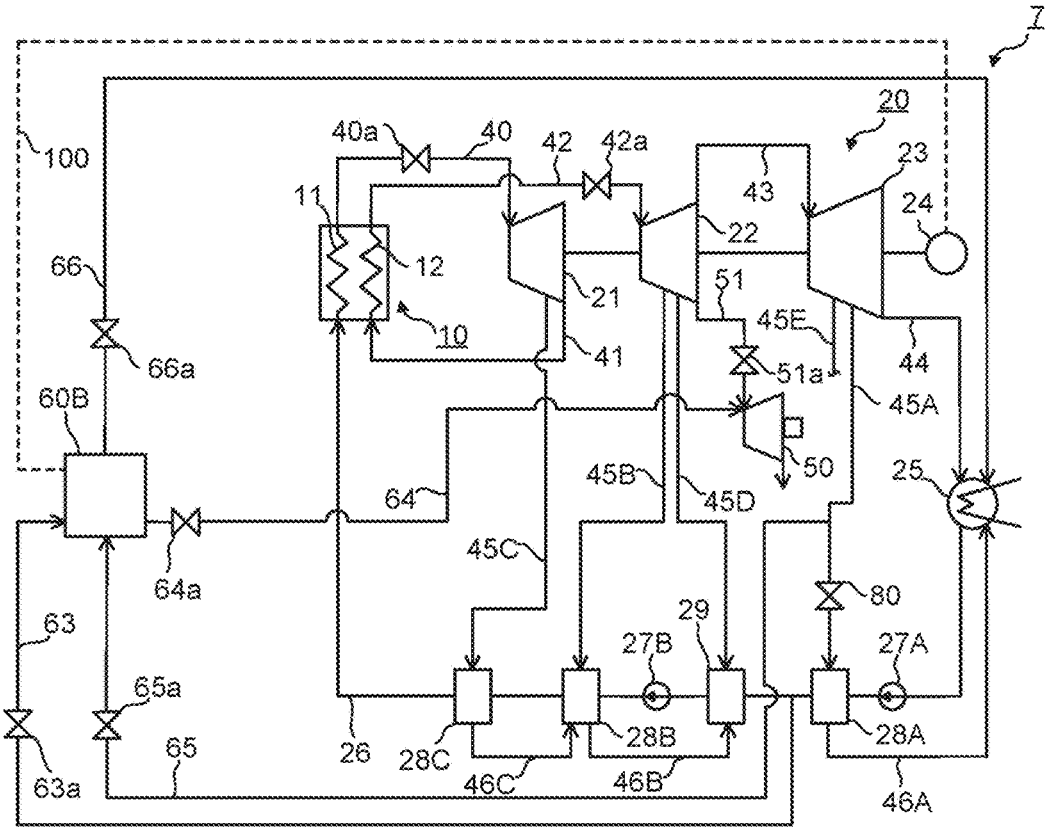
FIG. 26 is a system diagram schematically illustrating another form in the power generation facility in the seventh embodiment.
Figure 27:
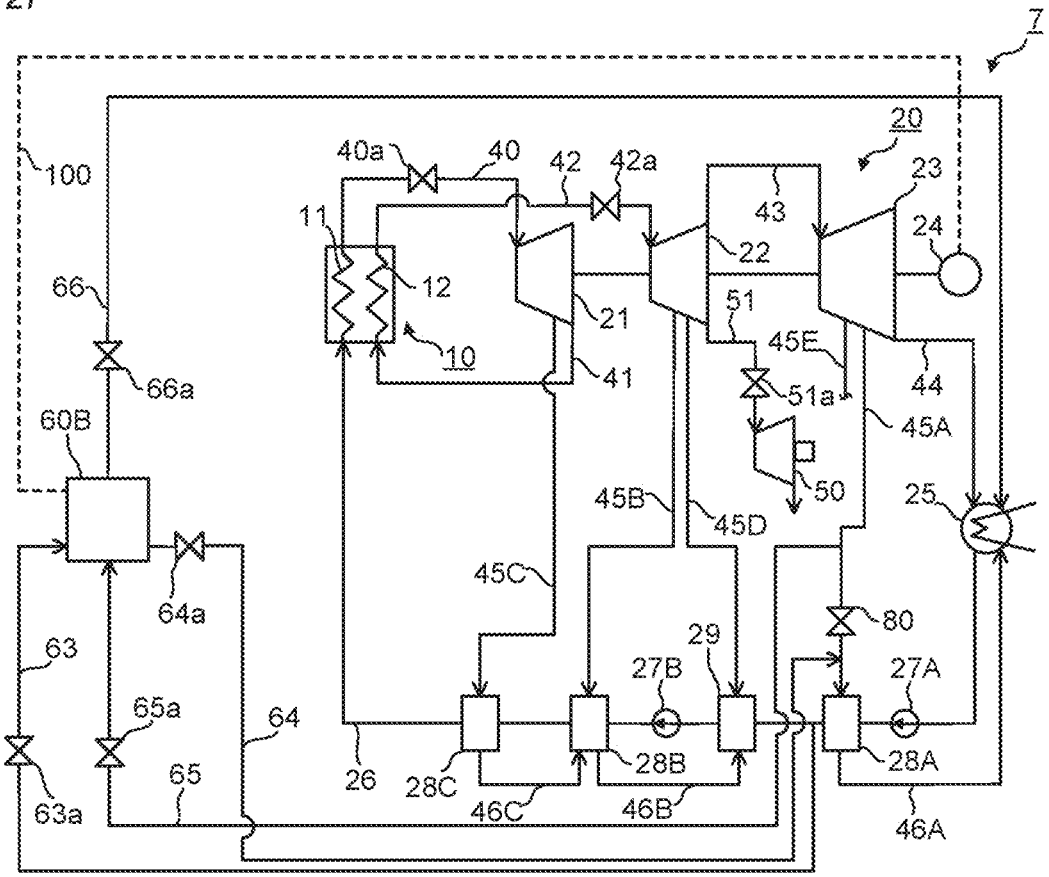
FIG. 27 is a system diagram schematically illustrating another form in the power generation facility in the seventh embodiment.

FIG. 26 and FIG. 27 each are a system diagram schematically illustrating another form in the power generation facility 7 in the seventh embodiment. In the forms illustrated in FIG. 26 and FIG. 27, the own system to which the steam generated in the heat storage and steam generation device 60B is supplied is different in the steam generation mode operation.

Here, the configuration for exhibiting the steam generation function in the form illustrated in FIG. 26 is referred to as an eighth steam generation structure. The operation in the eighth steam generation structure is referred to as an eighth steam generation mode operation. Further, the configuration for exhibiting the steam generation function in the form illustrated in FIG. 27 is referred to as a ninth steam generation structure. The operation in the ninth steam generation structure is referred to as a ninth steam generation mode operation.

The eighth steam generation structure and the ninth steam generation structure each include the heat storage and steam generation device 60B, the feedwater supply pipe for steam generation 63, the steam supply pipe 64, and the water supply pipe for heat storage material 65.

During the eighth steam generation mode operation and during the ninth steam generation mode operation, the action of generating superheated steam from feedwater is the same as that during the above-described seventh steam generation mode operation.

As illustrated in FIG. 26, in the eighth steam generation structure, one end of the steam supply pipe 64 is connected to the steam inlet of the feed pump drive turbine 50. During the eighth steam generation mode operation, the steam generated in the heat storage and steam generation device 60B is supplied to the feed pump drive turbine 50 through the steam supply pipe 64. At this time, the flow rate regulating valve 51*a* of the steam supply pipe 51 is closed. Therefore, the steam discharged from the intermediate-pressure turbine 22 is introduced into the low-pressure turbine 23 through the crossover pipe 43.

As above, the steam, which has been supplied to the feed pump drive turbine 50, is to be introduced into the low-pressure turbine 23, and thus the turbine output increases. This also allows the form illustrated in FIG. 26 to reach the required load in a short period of time and obtain excellent responsiveness to the load increase.

As illustrated in FIG. 27, in the ninth steam generation structure, one end of the steam supply pipe 64 is connected to the extraction steam pipe 45A. One end of the steam supply pipe 64 is connected to the side of the feedwater heater 28A relative to the position where the flow rate regulating valve 80 is provided.

During the ninth steam generation mode operation, the steam generated in the heat storage and steam generation device 60B is supplied to the extraction steam pipe 45A through the steam supply pipe 64. At this time, the flow rate regulating valve 80 is closed. The amount of extraction steam from the low-pressure turbine 23 results in the amount of the steam to be supplied to the heat storage and steam generation device 60B through the water supply pipe for heat storage material 65. Therefore, the amount of extraction steam from the low-pressure turbine 23 decreases and thus the turbine output increases. This also allows the form illustrated in FIG. 27 to reach the required load in a short period of time and obtain excellent responsiveness to the load increase.

Other Embodiments

The configurations of the embodiments including the heat storage and steam generation devices 60, 60A, and 60B described above may be applied to a gas turbine combined cycle power generation facility, for example. The gas turbine combined cycle power generation facility includes a heat recovery steam generator (HRSG) that uses heat of an exhaust gas from the gas turbine to generate steam. Then, the steam generated by the heat recovery steam generator is introduced into the steam turbine. In this case, the boiler device 10 in the embodiment functions as the heat recovery steam generator.

The superheated steam generated by the heat recovery steam generator is introduced into the high-pressure turbine 21 through the main steam pipe 40. Further, a reheat unit that reheats steam is provided in the heat recovery steam generator, and thereby the reheated steam is introduced into the intermediate-pressure turbine 22 through the high-temperature reheat steam pipe 42.

For example, part of the steam flowing through the main steam pipe 40 is supplied as steam for heat storage to the heat storage and steam generation devices 60 and 60A through the steam supply pipe for heat storage 61. Further, part of the steam flowing through the high-temperature reheat steam pipe 42 is supplied as steam for heat storage to the heat storage and steam generation devices 60 and 60A through the steam supply pipe for heat storage 61.

Here, even the gas turbine combined cycle power generation facility has a continuously operable minimum load constraint. Therefore, during the daytime when the supply of renewable energy increases, the surplus steam from the heat recovery steam generator is generated in the same manner as in the conventional steam power generation facility.

Further, when increasing the steam generation amount to meet the load increase request, a predetermined amount of time is required until the steam to be introduced into the steam turbine reaches the steam at a predetermined temperature and pressure, as in the conventional steam power generation facility.

Thus, by applying the configurations of the embodiments including the heat storage and steam generation devices 60, 60A, and 60B to the gas turbine combined cycle power generation facility, the effects as explained in the above-described embodiments can be obtained. Thereby, the gas turbine combined cycle power generation facility can also reach the required load in a short period of time and obtain excellent responsiveness to the load increase.

According to the above-explained embodiments, it becomes possible to obtain excellent load responsiveness to the load increase request.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power generation facility comprising:

a boiler that generates steam;

a first steam turbine into which the steam generated in the boiler is introduced;

a second steam turbine provided downstream of the first steam turbine in a flow direction of steam flow;

a condenser that condenses steam discharged from the second steam turbine;

a feed pipe that leads condensed water condensed in the condenser to the boiler as feedwater;

a heat storage and steam generation device having a heat storage function that uses surplus energy to store heat, and a steam generation function that has part of the feedwater led by the feed pipe introduced thereinto and turns the feedwater into a second steam by the stored heat; and a first steam supply pipe that supplies the second steam generated in the heat storage and steam generation device to a component included in the power generation facility, wherein the surplus energy is surplus electric power, and the heat storage and steam generation device includes a thermoelectric converter that generates the heat by the surplus electric power, and the heat storage and steam generation device uses the surplus electric power to store the heat generated by the thermoelectric converter, and wherein the heat storage and steam generation device includes:

a container filled with a chemical heat storage material;

a heat exchange pipe arranged between the chemical heat storage materials inside the container;

the thermoelectric converter that is arranged between the chemical heat storage material inside the container and uses the surplus electric power, which is the surplus energy, to generate the heat;

a water supply pipe that supplies water or water vapor to the chemical heat storage material; and a drain pipe that discharges water or water vapor generated by the chemical heat storage material, when the heat is stored in the heat storage and steam generation device, the surplus electric power is supplied to the thermoelectric converter, and the water or water vapor generated by the chemical heat storage material is discharged through the drain pipe, and when the second steam is generated in the heat storage and steam generation device, the water or water vapor is supplied from the water supply pipe to the chemical heat storage material, the feedwater is supplied from the feed pipe to the heat exchange pipe, and steam generated in the heat exchange pipe is supplied to the first steam supply pipe.

2. The power generation facility according to claim 1, further comprising:

a third steam turbine provided between the first steam turbine and the second steam turbine in the flow direction of the steam flow;

a reheat boiler that reheats steam discharged from the first steam turbine; and a high-temperature reheat steam pipe that introduces reheated steam reheated in the reheat boiler into the third steam turbine.

3. A power generation facility, comprising:

a boiler that generates steam;

a first steam turbine into which the steam generated in the boiler is introduced;

a second steam turbine provided downstream of the first steam turbine in a flow direction of steam flow;

a third steam turbine provided between the first steam turbine and the second steam turbine in the flow direction of the steam flow;

a reheat boiler that reheats steam discharged from the first steam turbine; and a high-temperature reheat steam pipe that introduces reheated steam reheated in the reheat boiler into the third steam turbine;

a condenser that condenses steam discharged from the second steam turbine;

a feed pipe that leads condensed water condensed in the condenser to the boiler as feedwater;

a heat storage and steam generation device having a heat storage function that uses surplus energy to store heat, and a steam generation function that has part of the feedwater led by the feed pipe introduced thereinto and turns the feedwater into a second steam by the stored heat; and a first steam supply pipe that supplies the second steam generated in the heat storage and steam generation device to a component included in the power generation facility, wherein the surplus energy is surplus electric power, and the heat storage and steam generation device includes a thermoelectric converter that generates the heat by the surplus electric power, and the heat storage and steam generation device uses the surplus electric power to store the heat generated by the thermoelectric converter, and the component included in the power generation facility to which the second steam is supplied by the first steam supply pipe is the second steam turbine.

* * * * *